US011932372B2

(12) United States Patent
Ripoll

(10) Patent No.: US 11,932,372 B2
(45) Date of Patent: Mar. 19, 2024

(54) SELF-CONTAINED MARINE AIR CONDITIONING UNIT, AIR-CONDITIONING SYSTEM, AND METHOD OF INSTALLATION

(71) Applicant: Javier Ripoll, Doral, FL (US)

(72) Inventor: Javier Ripoll, Doral, FL (US)

( * ) Notice: Subject to any disclaimer, the term of this patent is extended or adjusted under 35 U.S.C. 154(b) by 290 days.

(21) Appl. No.: 17/175,052

(22) Filed: Feb. 12, 2021

(65) Prior Publication Data

US 2022/0126973 A1 Apr. 28, 2022

Related U.S. Application Data

(60) Provisional application No. 63/104,189, filed on Oct. 22, 2020.

(51) Int. Cl.
*B63J 2/02* (2006.01)
*F25B 13/00* (2006.01)

(52) U.S. Cl.
CPC ..... *B63J 2/02* (2013.01); *F25B 13/00* (2013.01)

(58) Field of Classification Search
CPC ... B60H 1/3226; B63J 2/00; B63J 2/02; B63J 2/12; B63J 2/04
See application file for complete search history.

(56) References Cited

U.S. PATENT DOCUMENTS 2,185,387 A * 1/1940 Welland ..... F24F 1/022 62/427
3,721,104 A * 3/1973 Adler ..... F25B 49/02 62/503
3,760,601 A * 9/1973 Bunten ..... F24F 5/0007 62/262
3,888,090 A * 6/1975 Meyer ..... F24F 13/224 62/426
5,237,832 A * 8/1993 Alston ..... F25B 1/00 62/200

(Continued)

FOREIGN PATENT DOCUMENTS

CN 104613559 A * 5/2015
EP 2196390 A1 * 6/2010 ..... B63J 2/04

(Continued)

OTHER PUBLICATIONS

KR200351554Y1 English machine translation (Year: 2003).*
KR100749019B1 English machine translation (Year: 2004).*

*Primary Examiner* — Jenna M Hopkins
(74) *Attorney, Agent, or Firm* — Melvin K. Silverman

(57) ABSTRACT

A do-it-yourself-friendly self-contained marine air conditioning unit, marine air conditioning system, and method for installation is disclosed. The unit includes a seawater cooling circuit, a refrigerant circuit, and a blower assembly. The refrigerant circuit includes a reverse valve connecting a compressor, an evaporator, and a refrigerant tube thermally engaged with a titanium condenser coil. The seawater cooling circuit includes the titanium condenser coil. The titanium condenser coil has a titanium condenser coil outflow and a titanium condenser coil inflow. The blower assembly is mounted in communication with the evaporator, wherein the blower assembly may pull air through the evaporator. This blower is capable of achieving up to 270-degrees of rotation about a single axis. The system also includes a universal controller to allow for optimal integration with existing systems.

1 Claim, 23 Drawing Sheets

(56) References Cited

U.S. PATENT DOCUMENTS 5,697,227 A * 12/1997 Bruce ..... F24F 1/027 62/298
5,848,536 A * 12/1998 Dodge ..... B63J 2/04 62/286
6,263,689 B1 * 7/2001 Dodge ..... B63J 2/04 62/240
7,278,272 B2 * 10/2007 Huston ..... B63J 2/04 62/240
7,328,590 B2 * 2/2008 Sherlock ..... F28F 19/06 62/305
8,056,351 B2 * 11/2011 Marciano ..... F24F 13/14 62/239
8,555,669 B1 * 10/2013 LeBlanc ..... F24F 1/14 62/428
9,447,997 B2 * 9/2016 Kyle ..... B63J 2/04
2005/0236013 A1 * 10/2005 Huston ..... B63J 2/04 134/1
2008/0047289 A1 * 2/2008 Patrick ..... F24F 13/32 62/285
2008/0190120 A1 * 8/2008 Marciano ..... F24F 13/222 62/77
2008/0196436 A1 * 8/2008 Connell ..... B60H 1/00378 62/323.3
2008/0202138 A1 * 8/2008 Pabisz ..... B63J 2/04 62/240
2010/0251739 A1 * 10/2010 Mabru ..... B63J 2/04 62/240
2012/0258839 A1 * 10/2012 Smithson ..... B60H 1/3222 477/42
2014/0360221 A1 * 12/2014 Kyle ..... B63J 2/04 62/426
2016/0144692 A1 * 5/2016 Brown ..... B60H 1/3226 62/133
2021/0053666 A1 * 2/2021 Lewis ..... F24F 13/30
2022/0126973 A1 * 4/2022 Ripoll ..... F25B 13/00
2023/0356824 A1 * 11/2023 Ripoll ..... B63J 2/04

FOREIGN PATENT DOCUMENTS

FR 2865796 A3 * 8/2005 ..... F24F 13/20
KR 200351554 Y1 * 5/2004
KR 100749019 B1 * 8/2007
KR 20120001017 U * 2/2012
SE 505576 C2 * 9/1997 ..... B63J 2/12
WO WO-2004090440 A1 * 10/2004 ..... B60H 1/00428
WO WO-2008129592 A1 * 10/2008 ..... B63B 35/26
WO WO-2014199250 A1 * 12/2014 ..... B63J 2/02
WO WO-2022162534 A1 * 8/2022

* cited by examiner

SELF-CONTAINED MARINE AIR CONDITIONING UNIT, AIR-CONDITIONING SYSTEM, AND METHOD OF INSTALLATION

CROSS-REFERENCE TO RELATED APPLICATIONS

This application claims the benefit of U.S. Provisional Patent Application Ser. No. 63/104,189, entitled Self-Contained Marine Air-Conditioning Unit, filed Oct. 22, 2020, hereby incorporated by reference in its entirety for all purposes.

FIELD OF ART

The present invention is related to self-contained marine air-conditioning units.

BACKGROUND

As marine watercrafts evolve, the size and amenities provided in the cabin expand. Air conditioners have been adapted to work within marine watercrafts to provide further comfort to the occupants therein. One example of a marine air conditioner is U.S. Pat. No. 5,848,536, which discloses a self-contained marine air conditioner.

Since then, there have been advancements in weight, size, components, power, and configurability. A most recent invention in the field of marine air conditioners and configurable air conditioners, U.S. Pat. No. 8,056,351 ('351 Patent) directed to "Blower for Marine Air Conditioner", discloses a rotatable blower.

While many marine air conditioning units are in a fixed orientation, and thus, a watercraft must be rearranged to accommodate such units, the '351 Patent offers a solutions that allow a user to install a marine air conditioning unit that allows the installer to adjust the blower output thereby increasing the available mounting locations for the air conditioning unit. This patent adds to teachings of increased configurability, however, this concept is not new. U.S. Pat. No. 2,185,387 ('387 Patent) also discloses a blower that is rotatable. The main differences between the two patents are the means that are used to fasten the blower duct to the blower, and the functional advantages that provides. The '387 Patent accomplishes this by using a square mounting plate, fastened by screws and rotatable around a guiding cover. The '351 Patent accomplishes this by using a band clamp to allow omnidirectional adjustment. However, band clamps are not new in the air conditioning industry, and they do carry limitations on securement.

Thus, there has been a lack of innovation in marine air conditioning units in recent years, and new innovations are needed to keep up with the demanding conditions face by marine watercrafts.

Further, there is a severe lack of systems available that allow for a do-it-yourself installation. Further, there are several configurations that are needed to provide for a do-it-yourself installation that have not been contemplated, including ease of installation, connection to existing components, and corrosion resistance to provide for a lower-maintenance unit. This lack in the market remains unfulfilled, and the invention herein seeks to provide a solution for these unsolved problems.

SUMMARY OF THE INVENTION

Provided is a self-contained marine air conditioning unit configured for easy do-it-yourself installation, including a seawater cooling circuit, a refrigerant circuit. The unit also includes and a blower assembly for moving air through the cooling parts of the air conditioning unit. The blower assembly is mounted in communication with said evaporator, wherein said blower assembly may pull air through said evaporator. The refrigerant circuit includes the reverse valve, wherein the reverse valve connects the compressor, the evaporator, and a refrigerant tube thermally engaged with the titanium condenser coil. This thermal engagement allows for a thermal transfer between the temperature of the refrigerant in the tube and the seawater in the titanium condenser coil. The seawater cooling circuit includes the titanium condenser coil. The titanium condenser coil has a titanium condenser coil outflow and a titanium condenser coil inflow.

Further provided is the self-contained marine air conditioning unit having a blower assembly containing a blower fan with a motor, wherein the blower assembly is incrementally rotatable up to 270-degrees about a single axis. A cylindrical mounting bracket fastened to the blower assembly, a connection bracket between the evaporator and the blower assembly having an evaporator side and a blower side.

The evaporator side of the connection bracket is configured to cover the evaporator. The blower side of the connection bracket includes a central aperture with a cylindrical mounting area with a plurality of screw apertures therein. The cylindrical mounting area is configured to receive the cylindrical mounting bracket within its inner periphery and provide a tight connection between the cylindrical mounting bracket of the blower assembly and the cylindrical mounting area of the blower side of the connection bracket wherein the mounting bracket of the blower assembly is secured to the connection bracket by a series of screws that feed through a series of screw apertures in the cylindrical mounting bracket and the screw apertures in the cylindrical mounting area of the blower side of the connection bracket.

Also provided is an evaporator, a base having a base drain pan, at least one condensate drains, and at least two handles, wherein the base is a stainless-steel frame base. The base drain pan is molded from a unitary piece of material, such as plastic, specifically ABS plastic. The handles are formed with the material of the base drain pan and are configured to be located near the heaviest points of the marine air conditioning unit to provide a stable point for a user to pick up the unit, wherein one handle is located proximal to the evaporator and a second handle is located proximal to the dryer. Sound and vibration dampening elements are also included, wherein the vibration dampening elements include at least one of an adhesive foam affixed to an outer surface of the blower assembly, and vibration absorbing adhesive tape configured to be affixed to an underside of the base drain pan.

Yet further provided with the marine air conditioner is a reverse valve, a compressor, a condenser coil, coil outflow, coil inflow, evaporator air filter, at least one duct mounting ring, a dryer, a high-pressure switch, an electrical box with fire retardant cover, a control board with universal connection terminals, and a power and control source connection incorporated within a single plug.

Also provided is a marine air conditioning system, including a marine air conditioner, an air supply, a grill for the air supply, an insulated duct connecting the blower assembly to the air supply, an air return located in close proximity to the evaporator of the marine air conditioning unit, a grill for the air return, a seawater cooling system, at least one condensate drain, an air conditioning unit electrical box providing power and control signals to the marine air conditioning system, wherein the electrical box includes a fire retardant cover, a universal control board within the air conditioning unit electrical box, a system control display unit connected to the control board in the air conditioning unit electrical box, and a power and control source connection incorporated within a single plug.

The inventive disclosure also provides for a method for installing a pre-charged and pre-wired marine air conditioning system, including providing a marine air conditioning system for easy connections, an air supply, a grill for said air supply, an insulated duct connecting said blower assembly to said air supply, wherein said insulated duct is defined as an inner thermal foil duct hose with a fiberglass insulation layer that is slidably capable of exposing said inner thermal foil duct for installation, an air return located in close proximity to the evaporator of the marine air conditioning unit, a grill for said air return, a seawater cooling system, at least one condensate drain, wherein said at least one condensate drain further includes a hose barb installed in each drain hole in said base drain pan, wherein a threaded male end of each hose barb engages with a complimental threaded female aperture, a marine grade hose, wherein said marine-grade hose is snugly-fitted over the barbed end of said hose barb, a stainless steel hose clamp fitted to provide a secure connection between said hose and said hose barb, and a collection point wherein condensate may drain, an air conditioning unit electrical box providing power and control signals to said marine air conditioning system wherein said electrical box includes a fire retardant cover, a universal control board within said air conditioning unit electrical box, a system control display unit connected to said control board in said air conditioning unit electrical box, and a power and control source connection incorporated within a single plug.

The method provided herein further includes installing vibration absorbing adhesive tape on the base of said marine air conditioner to dampen vibrations, if vibration absorbing adhesive tape is not already installed, mounting the marine air conditioner of said marine air conditioning system away from grill for the air return to minimize sound level in a cabin of the watercraft if possible, mounting the marine air conditioner of said marine air conditioning system with said condenser and evaporator directly behind said grill for the air return if adjacent to a bulkhead or other obstruction, mounting the marine air conditioner of said marine air conditioning system with said condenser and evaporator coil at least three inches of air circulation clearance if adjacent to a bulkhead or other obstruction, and said marine air conditioner cannot be mounted directly behind said grill for the air return, adjusting a rotational orientation of said blower assembly, if needed, by loosening the lock screw from one of said lock screw apertures, rotating said blower assembly about said blower assembly's single axis perpendicular to said blower fan blades between 0 and 270 degrees, and tightening said lock screw once said blower assembly is adjusted to a desired position, Installing a plurality of mounting brackets to said base drain pan of said marine air conditioner, wherein said mounting brackets hook around a lip-wall surrounding said base drain pan, wherein a screw secures the mounting bracket through an aperture in a bottom portion of said mounting bracket to a flat level mounting surface, placing and tightening a set of hose barbs in each drain hole in said base drain pan, wherein a threaded male end of each hose barb engages with a complimental threaded female aperture, fitting a marine grade drain hose is over the barbed end of said hose barbs, fastening a stainless steel hose clamp is to provide a secure connection between said drain hose and said hose barb, routing said drain hose from a collection point, connecting said marine air conditioner to said insulated duct by sliding back the fiberglass insulation layer on said duct to reveal the inner thermal foil duct hose, screwing at least three stainless steel screws through the thermal foil duct hose into a duct mounting ring, making sure wires of said thermal foil duct hose are secured by said screws to securely fasten said thermal foil duct hose to said duct mounting ring, sliding said fiberglass insulation layer back over said inner thermal foil duct hose, thereby covering said thermal foil duct hose, sealing said fiberglass insulation layer to said duct mounting ring with a condensation inhibiting tape, connecting an outflow of said pump to the coil inflow on said marine air conditioner with a reinforced marine-grade hose, connecting a discharge from the coil outflow on the marine air conditioner to a seawater outlet with a marine-grade hose, connecting the marine air conditioner to a universal control board configured to work with third-party thermostat systems, and connecting a thermostat system with control display to said connection terminal in said electrical box.

It is an object of the current invention to provide a system that is configured to allow for do-it-yourself installation.

It is another object of the invention to provide a self-contained, direct-expansion, seawater cooled, reverse-cycle air conditioner, air conditioner system.

It is yet another object of the invention to provide a quiet, powerful, and efficient.

It is further an object of the invention to provide a great option for new installs because of the ease of installation and self-contained construction, but also works as the perfect drop-in replacement for all major marine A/C brands.

It is another object of the invention to provide a long-lasting, corrosion-proof performance in even the toughest of marine environments.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
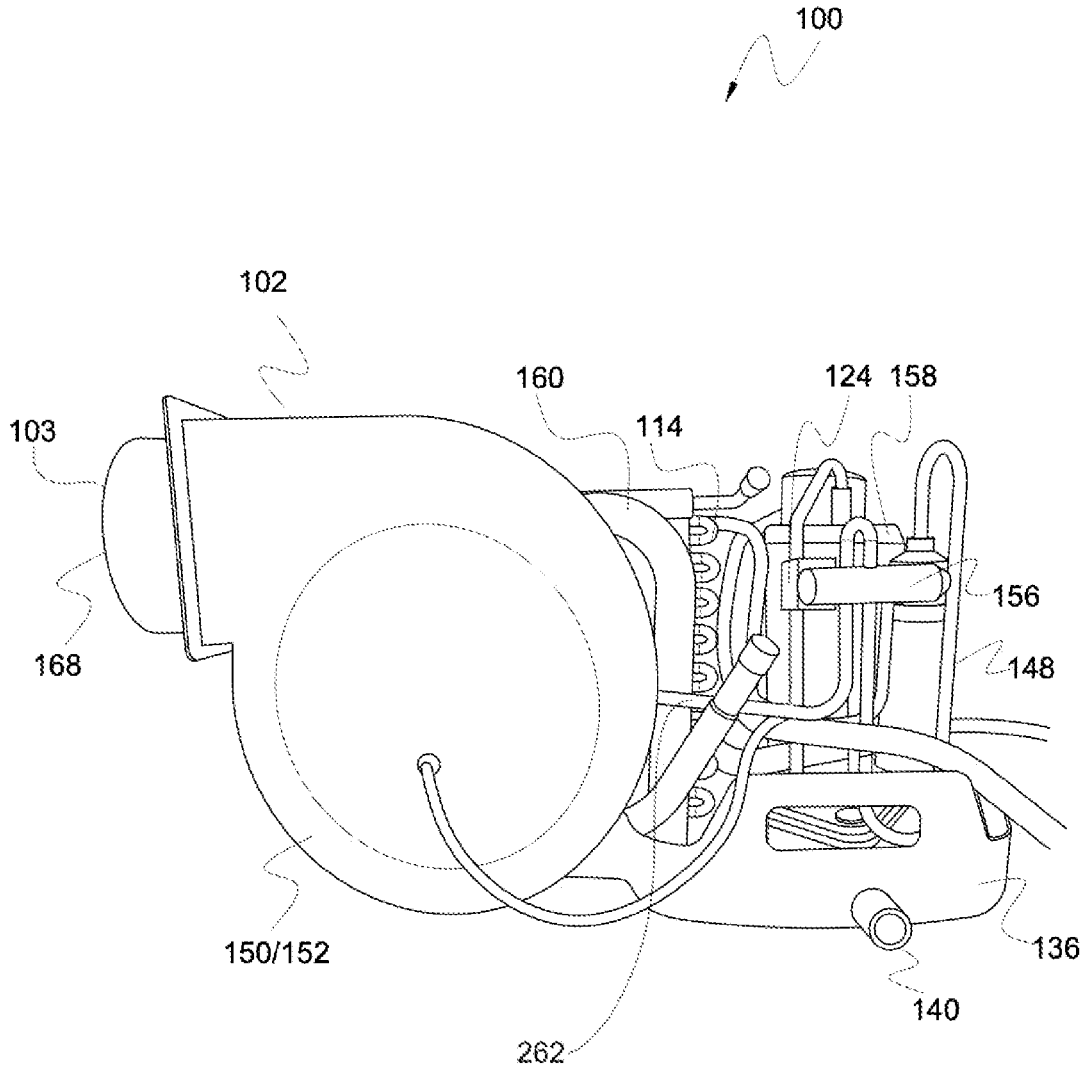
FIG. 1 is a left-side view of the marine air conditioning unit.

The present invention is a self-contained, direct-expansion, seawater cooled, reverse-cycle air conditioner, air conditioner system, and method for installing the air conditioning system. The air conditioner is designed for marine applications and is designed to have a compact design, high efficiency rotary compressor, 270-degree rotatable high-velocity blower, titanium condenser coil, insulated base drain pan, stainless steel frame base, electrical box with fire retardant cover, and operate quietly. The air conditioner is a pre-charged and pre-wired system for easy connectivity and ease of use as a do-it-yourself install. It also contains a single electrical control plug that sends power and control signals to the marine air conditioning unit to allow quick connections in do-it-yourself installations. Further, the marine air conditioning unit uses a universal control board to allow adaptability and versatility with replacement scenarios because it is configured to work with a range of third-party controllers and thermostats.

The unit is a self-contained marine air conditioning system, having a blower, evaporator, compressor, condenser coil, coil inflow and outflow tubes, evaporator air filter, base/base drain pan, at least one condensate drains, reverse valve, duct mounting ring, dryer, high pressure switch, and a handle.

The unit is quiet, powerful, and efficient, by using a 50-60HZ compressor with either or both 115V and 220V power inputs with an output of 16,000 BTUs providing powerful, quiet and efficient cooling.

The unit is a great option for new installs because of the ease of installation and self-contained construction, but also works as the perfect drop-in replacement for all major marine A/C brands.

The unit is configured to accept inputs of controls, thermostats, and cables, from major manufacturers, including, Dometic®, Cruisair®, MarineAire® and Micro Air to provide a replacement solution. This is accomplished through the use of a fully compatible and integrated Universal circuit board and a single plug that provides both power and control to the unit.

The unit is configured to be lightweight and have a small physical footprint, while still providing as much power as possible in the unit's footprint. The unit currently has the smallest footprint for an OEM or replacement unit, and lightest unit with a max weight of 59 pounds on the smallest configuration. The self-contained marine air conditioner is configured to fit in a footprint as small as 20"×12.5"×13.25".

To ensure long-lasting, corrosion-proof performance in even the toughest of marine environments, the unit includes titanium circulating condenser coils, stainless steel bolts and a stainless steel structural pan with plastic ABS tray in order to prevent corrosion. These titanium circulating coils are included for an extended anti-corrosion measure against salt water.

Because the system is configured to operate as an option for both new install and replacement, an easy connection plug is incorporated to make the unit a "Do it yourself" item to install. The easy one step connection for the "Do it yourself" plug allows the customer to install the unit without the need of a certified technician. This plug is configured to provide both power and control to the unit in a single plug.

The blower is quiet and adaptable for numerous installation situations. The blower is configured to achieve a rotation of up to 270 degrees within its single axis of rotation, and contains insulation material for the blower to reduce sound generated.

The inventive disclosure herein provides for a self-contained marine air conditioning unit 100, which can be primarily seen in FIGS. 1-3 and 9-14. The marine air conditioning unit 100 has a blower assembly 102 containing a blower fan 104 with a motor 106, an evaporator 114, a dryer 148, reverse valve 156, compressor 158, condenser coil 160, a high-pressure switch 124, an electrical box 170 acting as a power supply, and a universal control board 174.

The unit 100 includes a seawater cooling circuit, a refrigerant circuit. The unit 100 also includes and a blower assembly 102 for moving air through the cooling parts of the air conditioning unit 100. The blower assembly 102 is mounted in communication with said evaporator 114, wherein said blower assembly 102 may pull air through said evaporator 114. The refrigerant circuit includes the reverse valve 156, wherein the reverse valve 156 connects the compressor 158, the evaporator 114, and a refrigerant tube 262 thermally engaged with the titanium condenser coil 160. This thermal engagement allows for a thermal transfer between the temperature of the refrigerant in the tube and the seawater in the titanium condenser coil 160. The seawater cooling circuit includes the titanium condenser coil 160. The titanium condenser coil 160 has a titanium condenser coil outflow and a titanium condenser coil inflow.

The marine air conditioning unit 100 and its components can be primarily seen in FIGS. 1-14.

Figure 2:
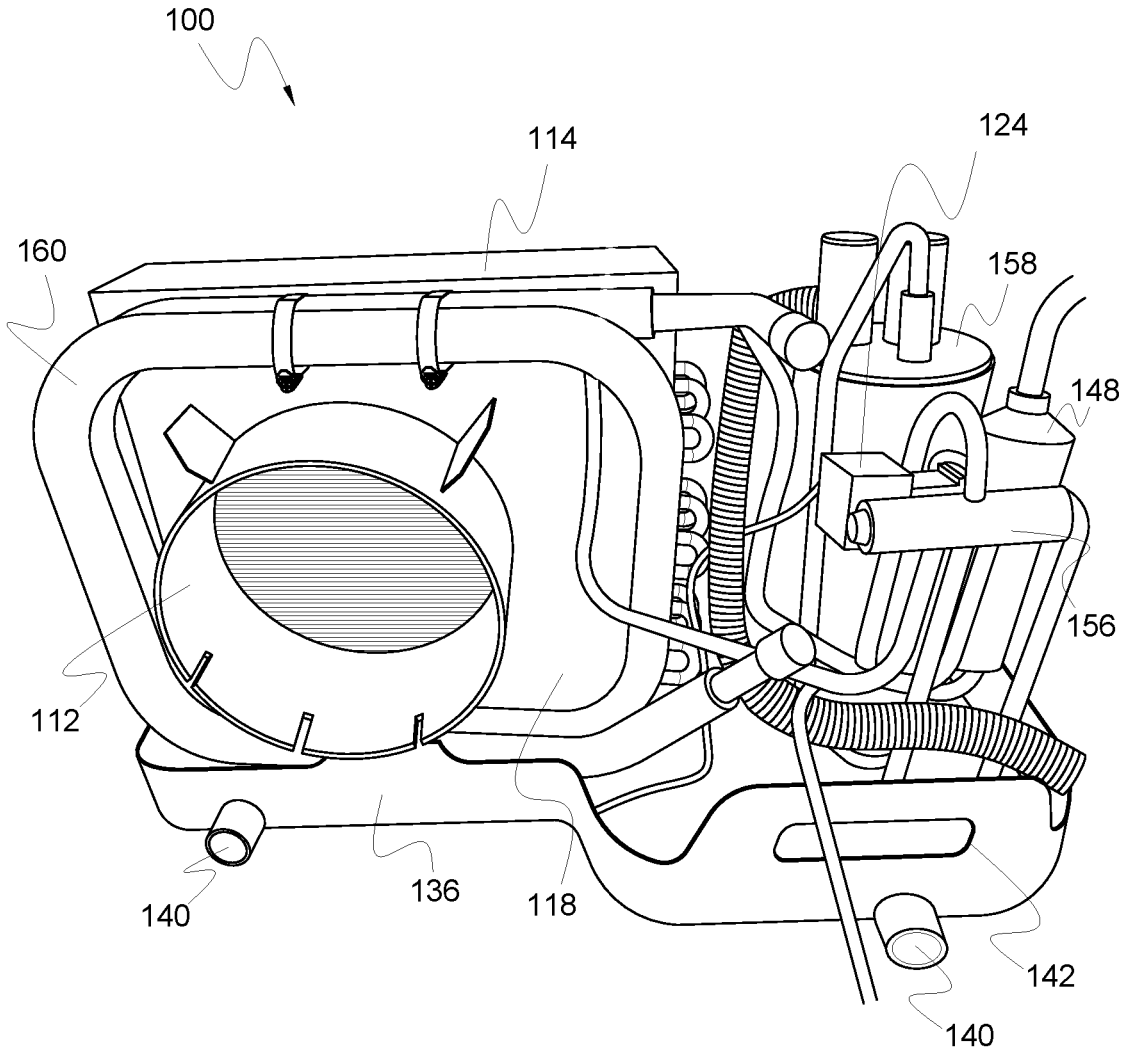
FIG. 2 is a left-side view of the marine air conditioning unit with blower removed.
Figure 3:
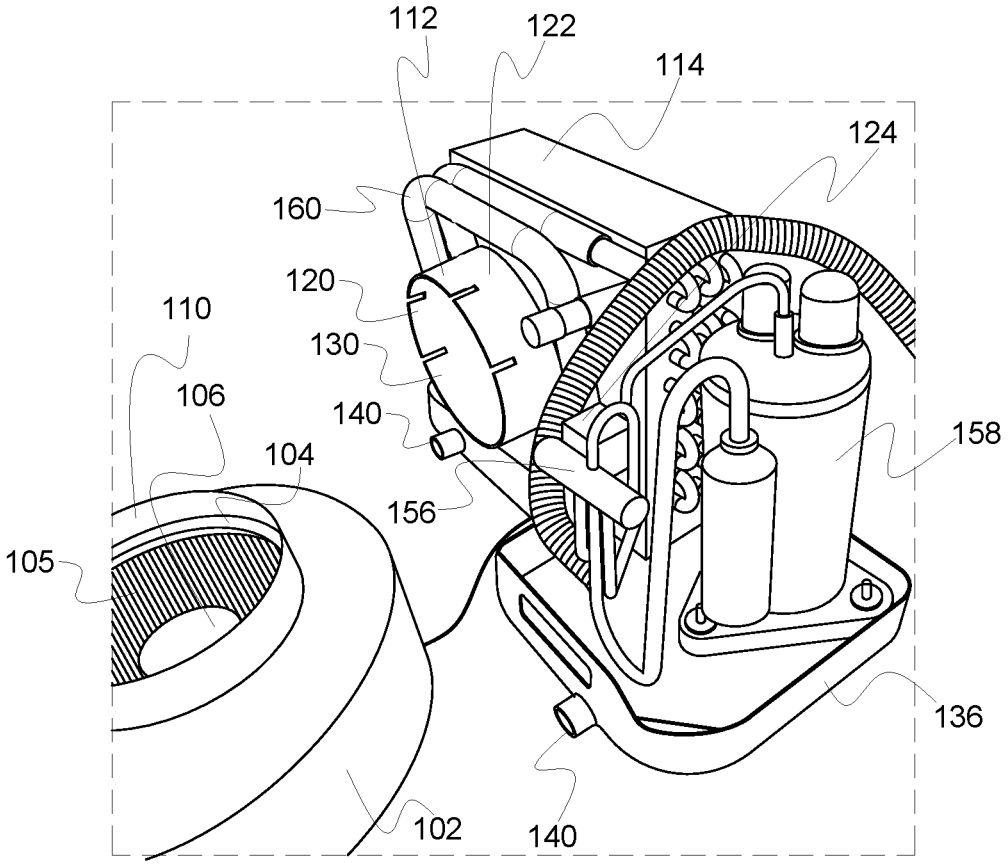
FIG. 3 is a rear perspective view of the marine air conditioning unit with blower disconnected.
Figure 4:
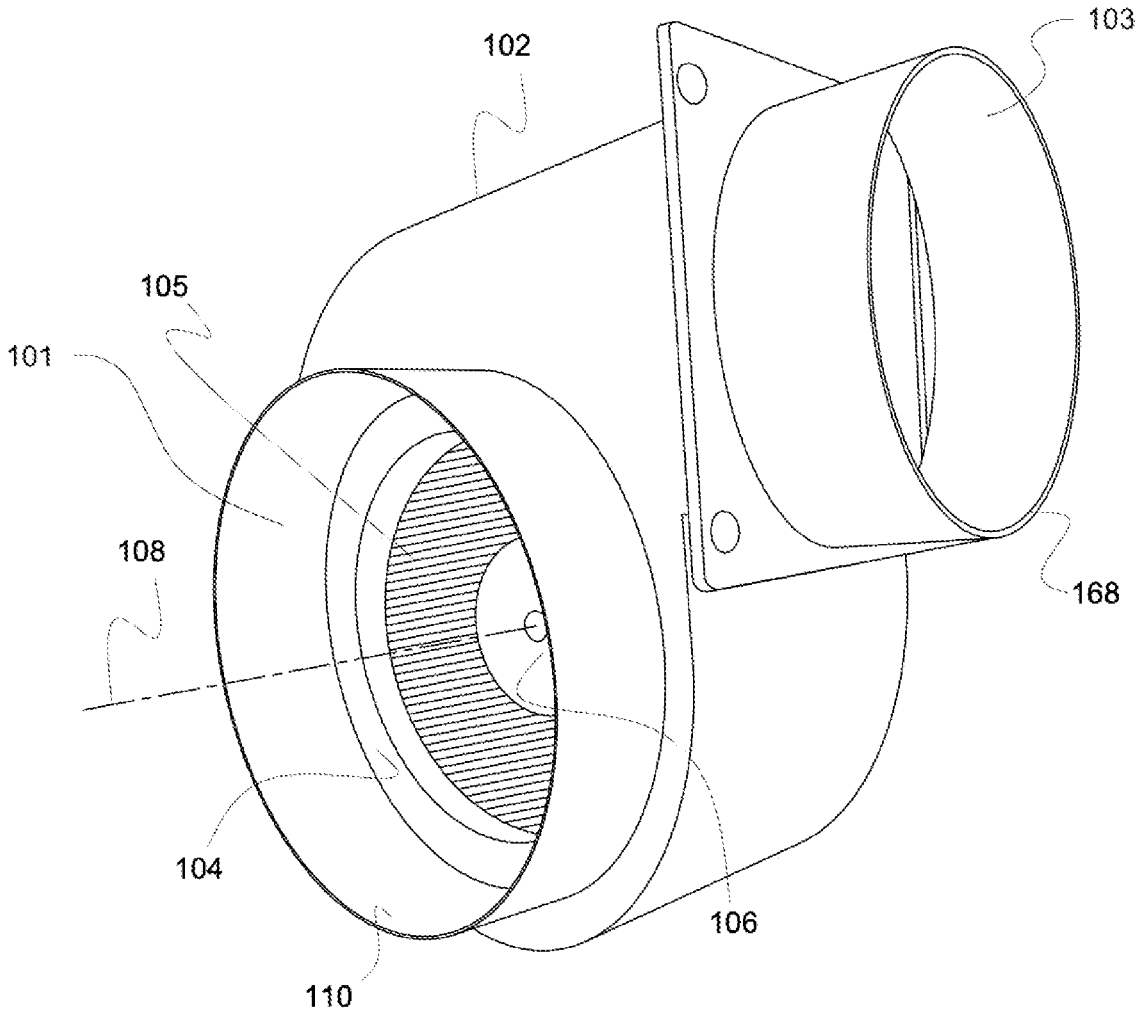
FIG. 4 is a right front perspective view of the blower of the marine air conditioning unit.
Figure 5:
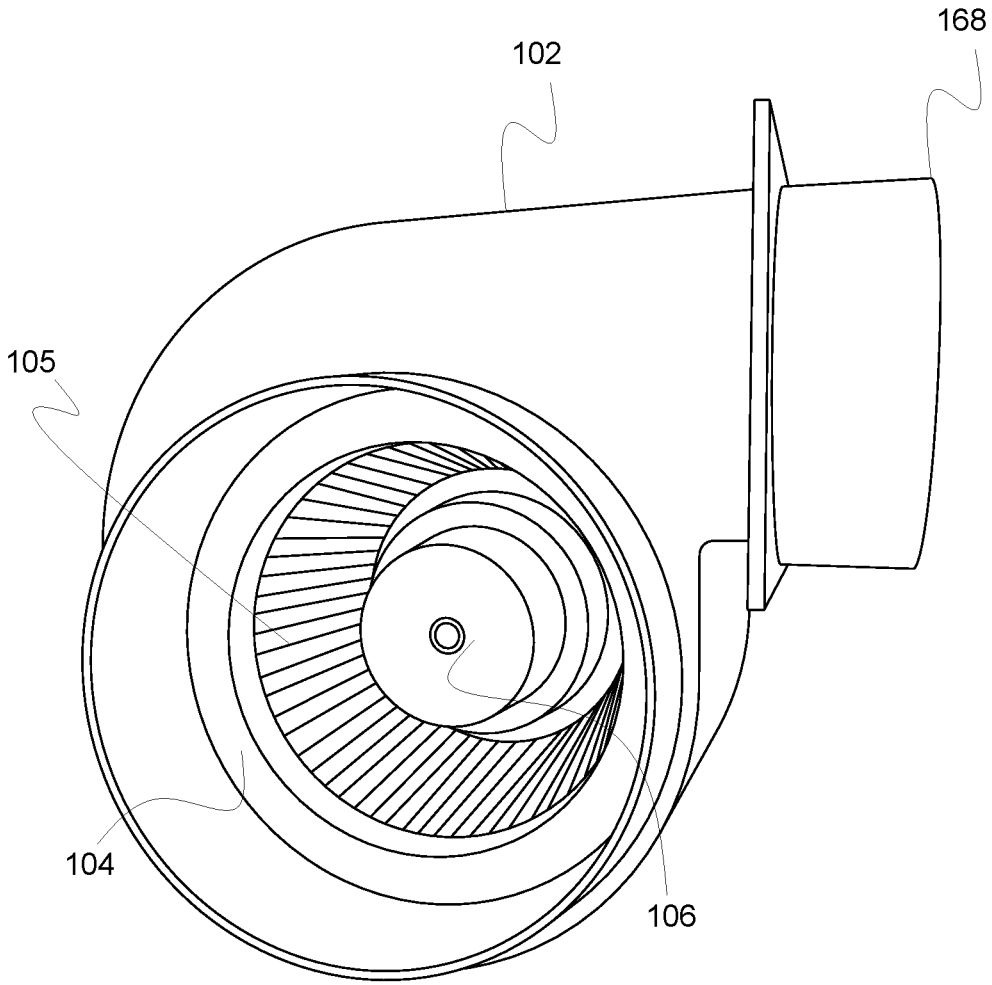
FIG. 5 is a right side view of the blower of the marine air conditioning unit.
Figure 6:
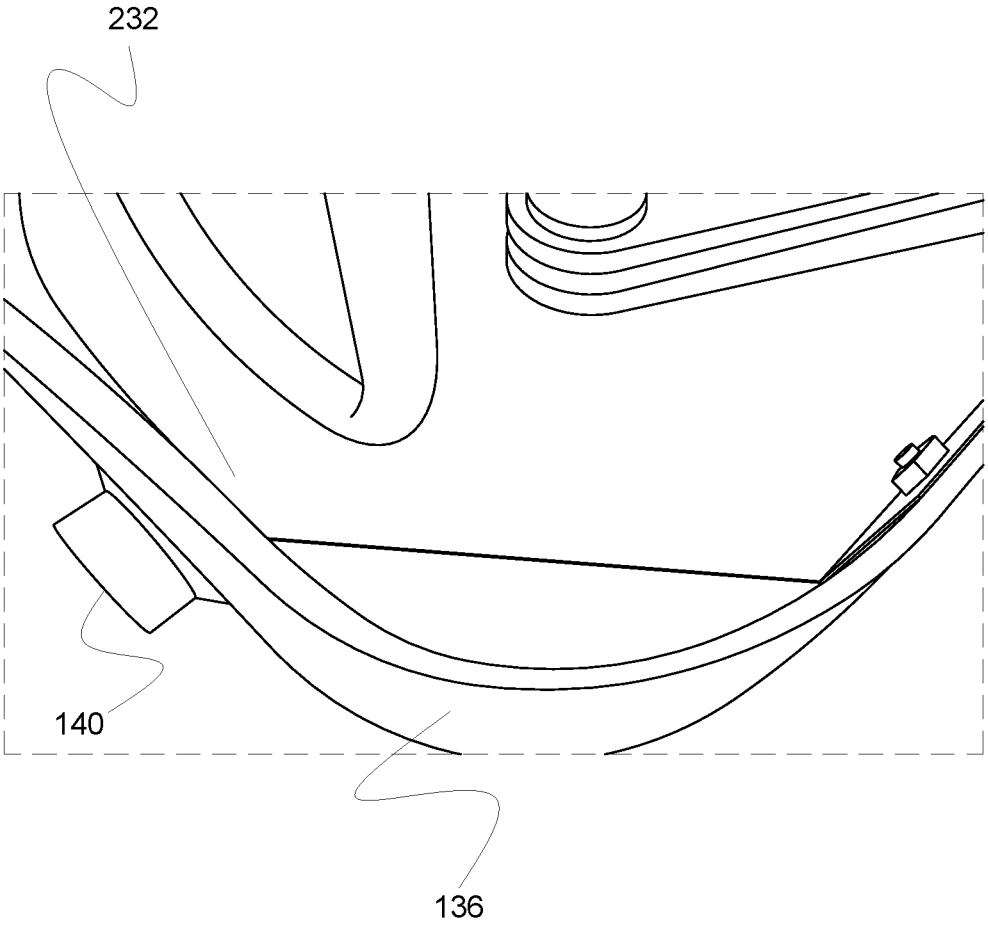
FIG. 6 is an enlarged view of the back left corner of the base drain pan of the marine air conditioning unit.
Figure 7:
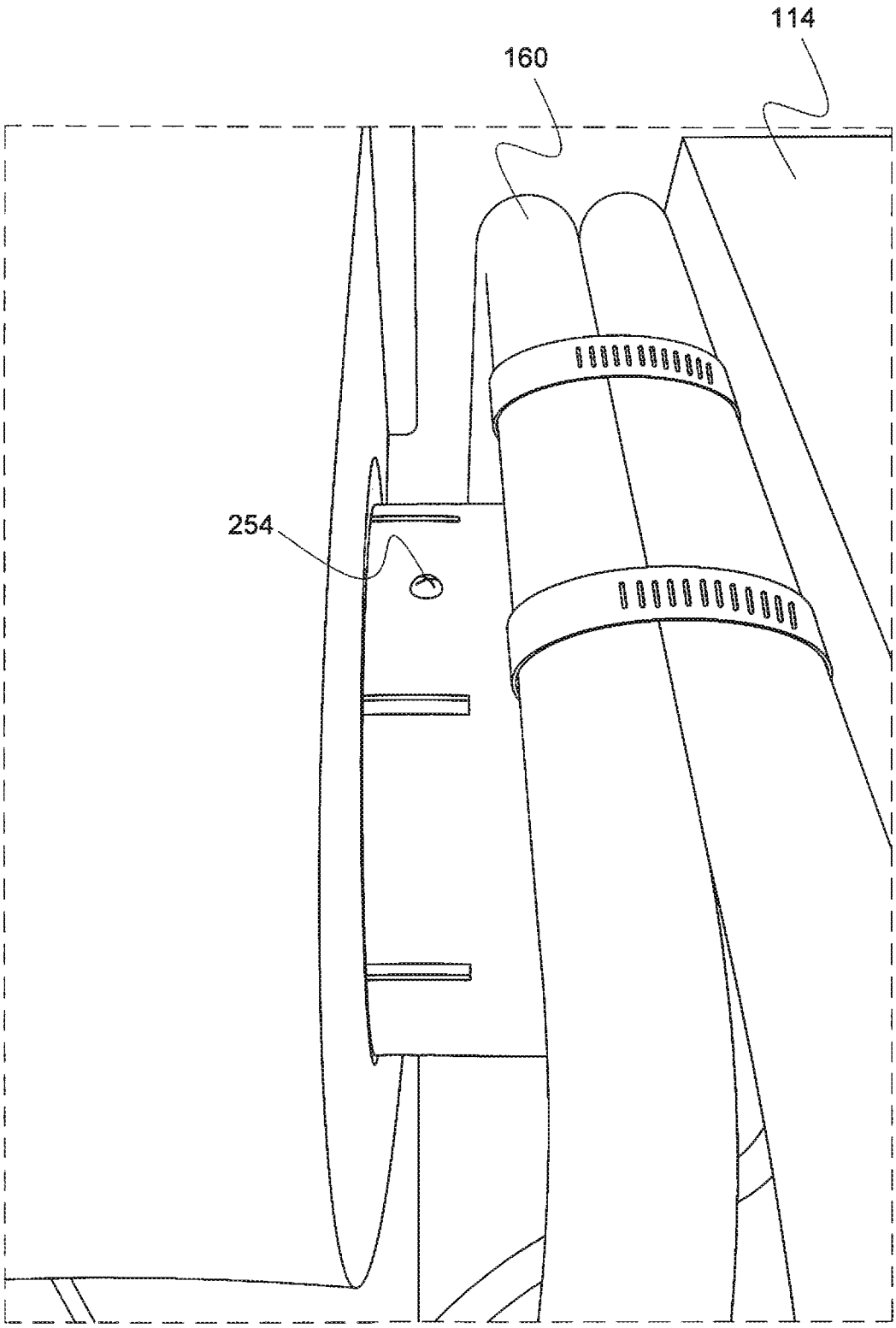
FIG. 7 is an enlarged perspective view of the connection point for the blower of the marine air conditioning unit without cable tie.
Figure 8:
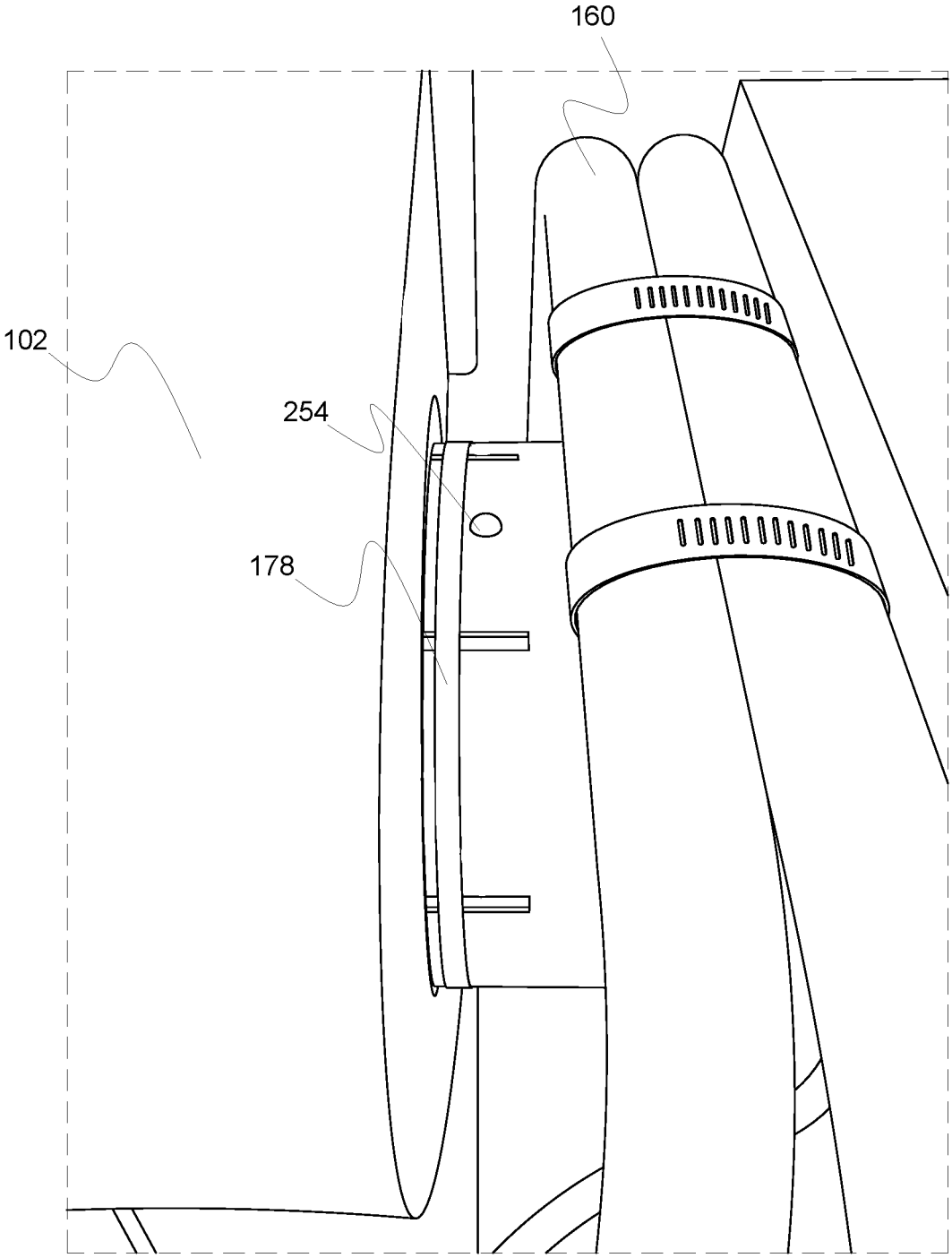
FIG. 8 is an enlarged perspective view of the connection point for the blower of the marine air conditioning unit with cable tie.
Figure 9:
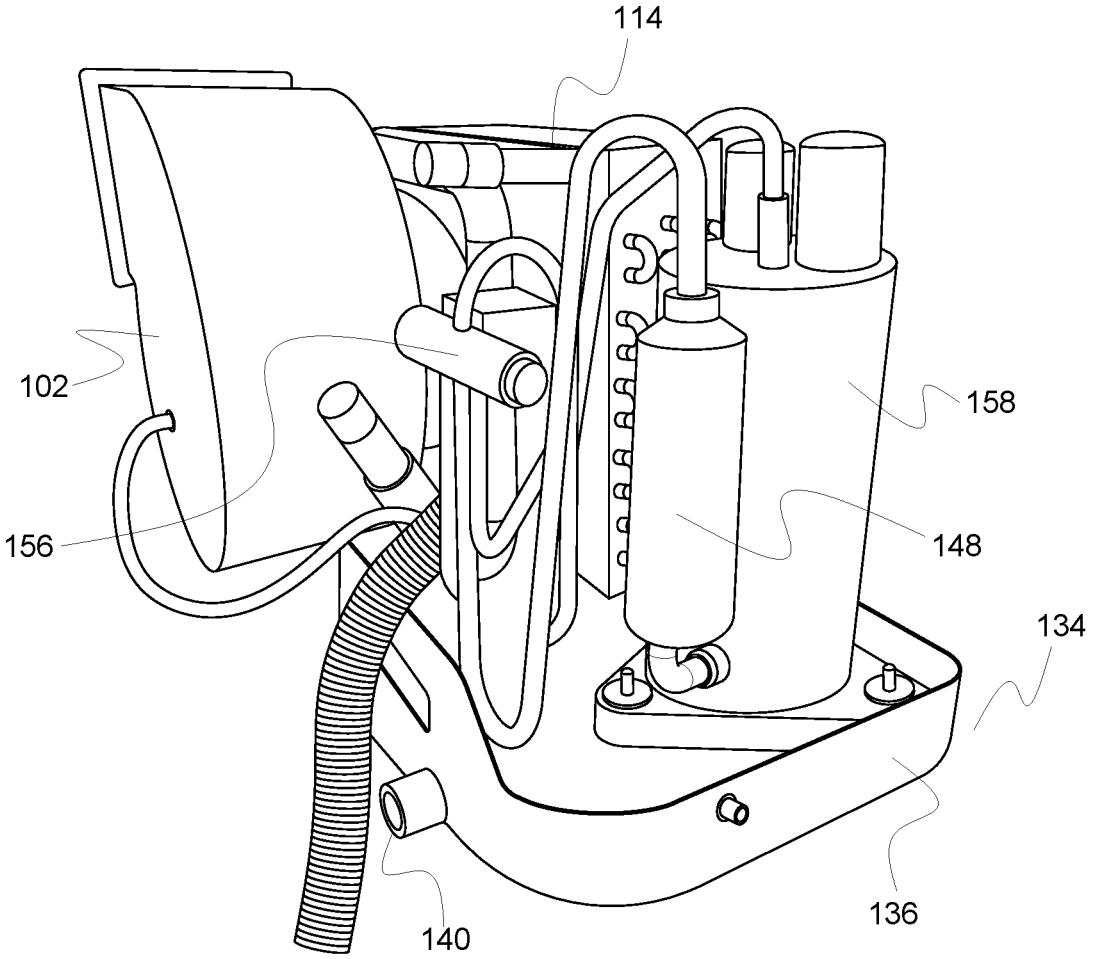
FIG. 9 is a rear left perspective view of the marine air conditioning unit.
Figure 10:
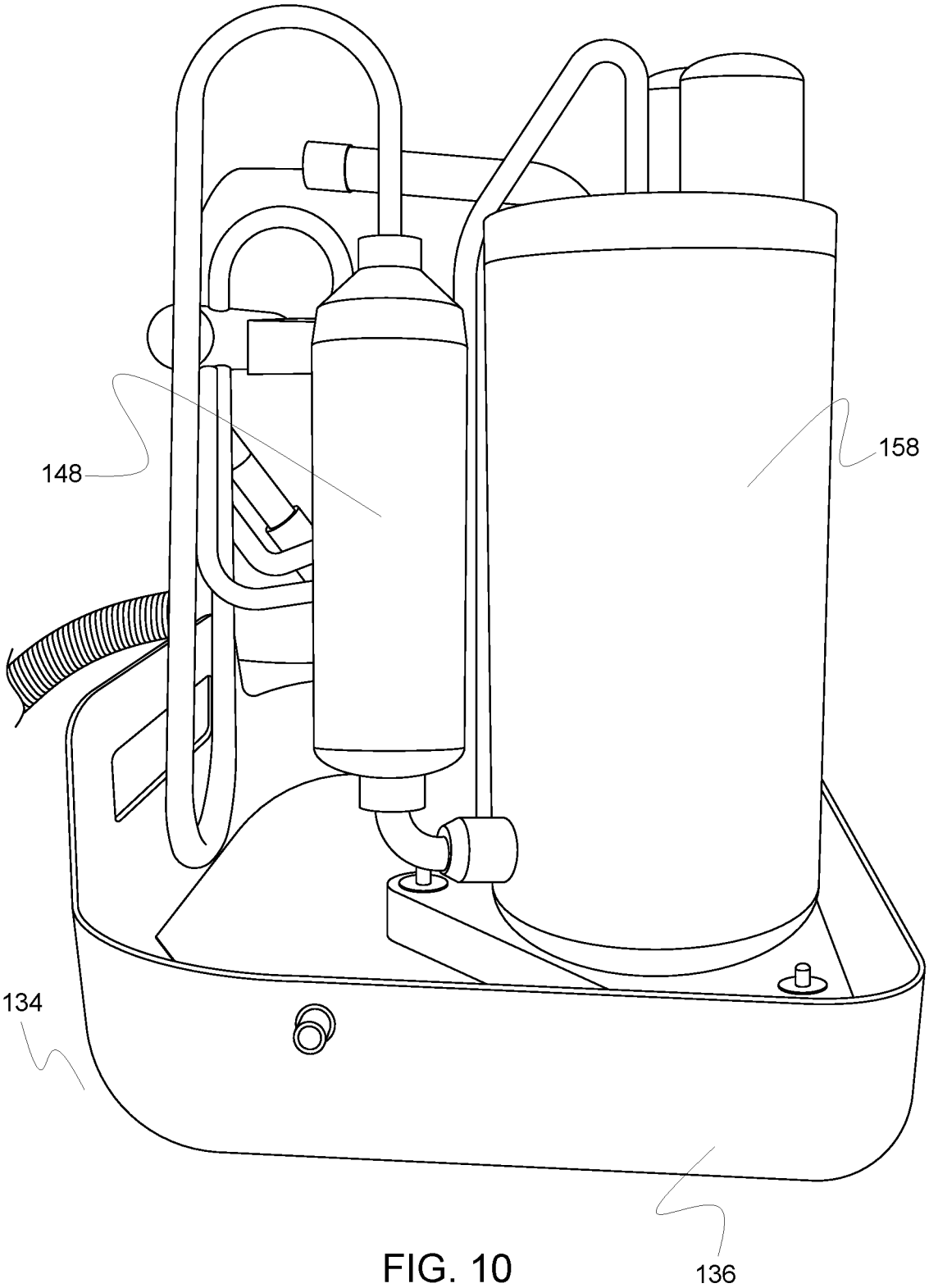
FIG. 10 is a rear view of the marine air conditioning unit.
Figure 11:
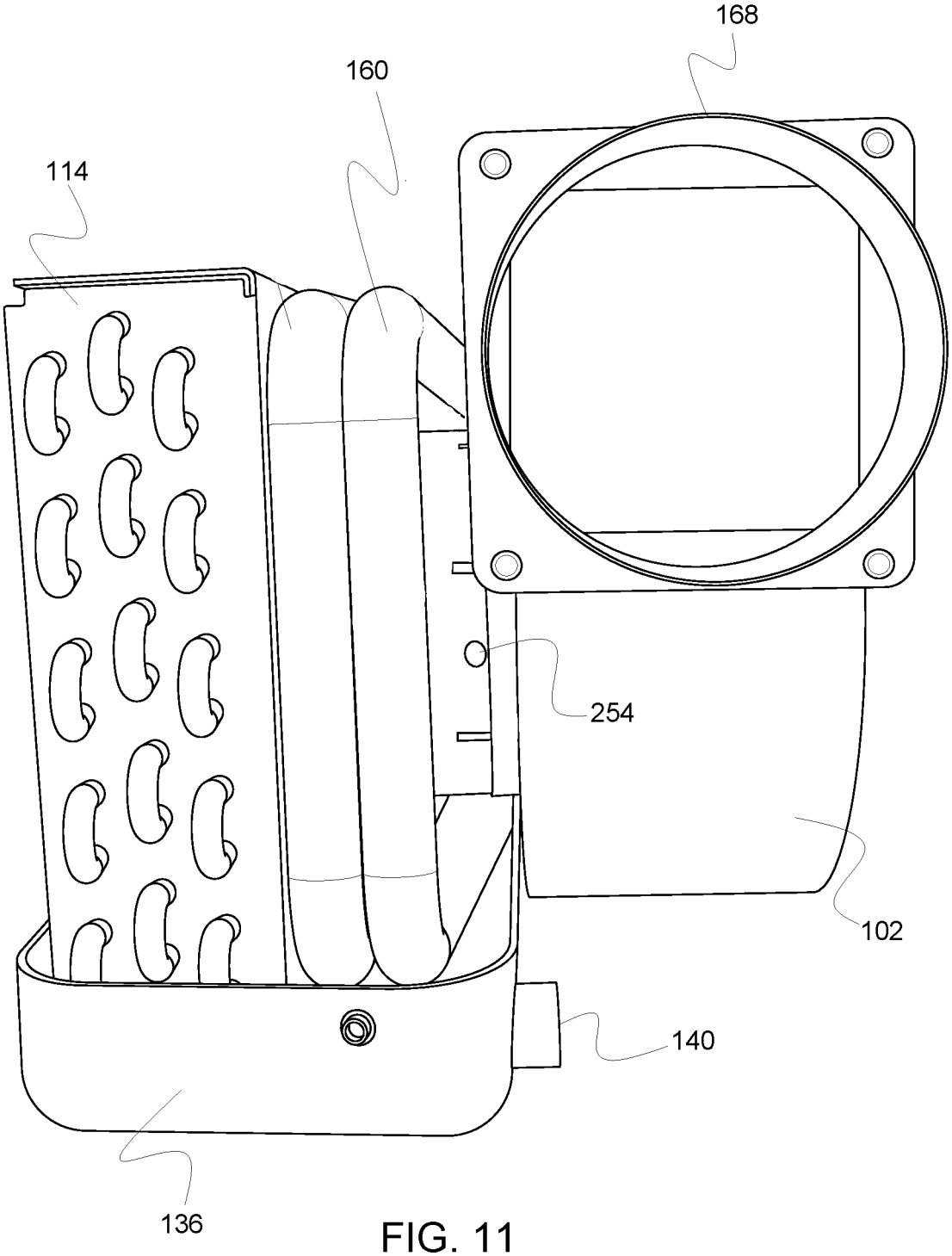
FIG. 11 is a front view of the marine air conditioning unit.
Figure 12:
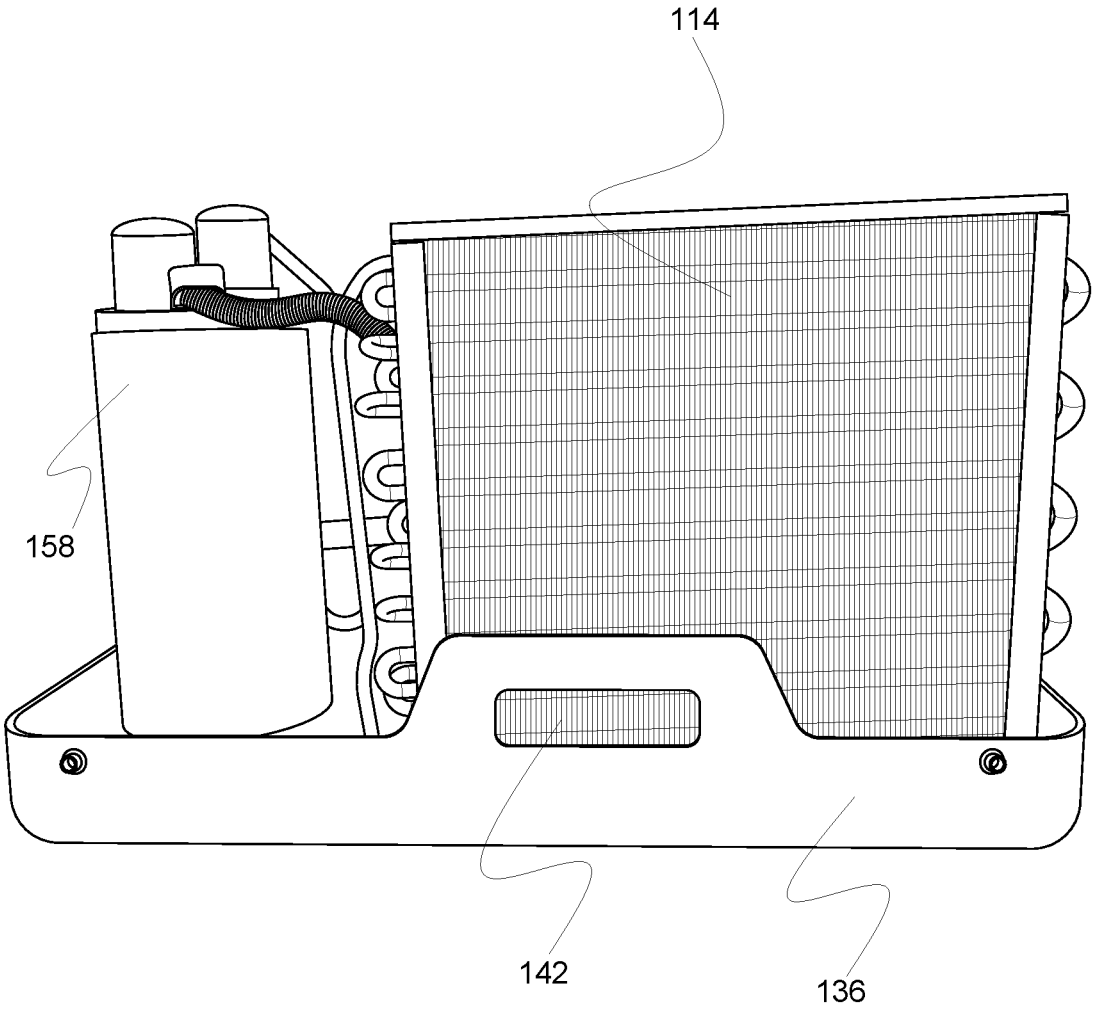
FIG. 12 is a right view of the marine air conditioning unit without evaporator filter.
Figure 13:
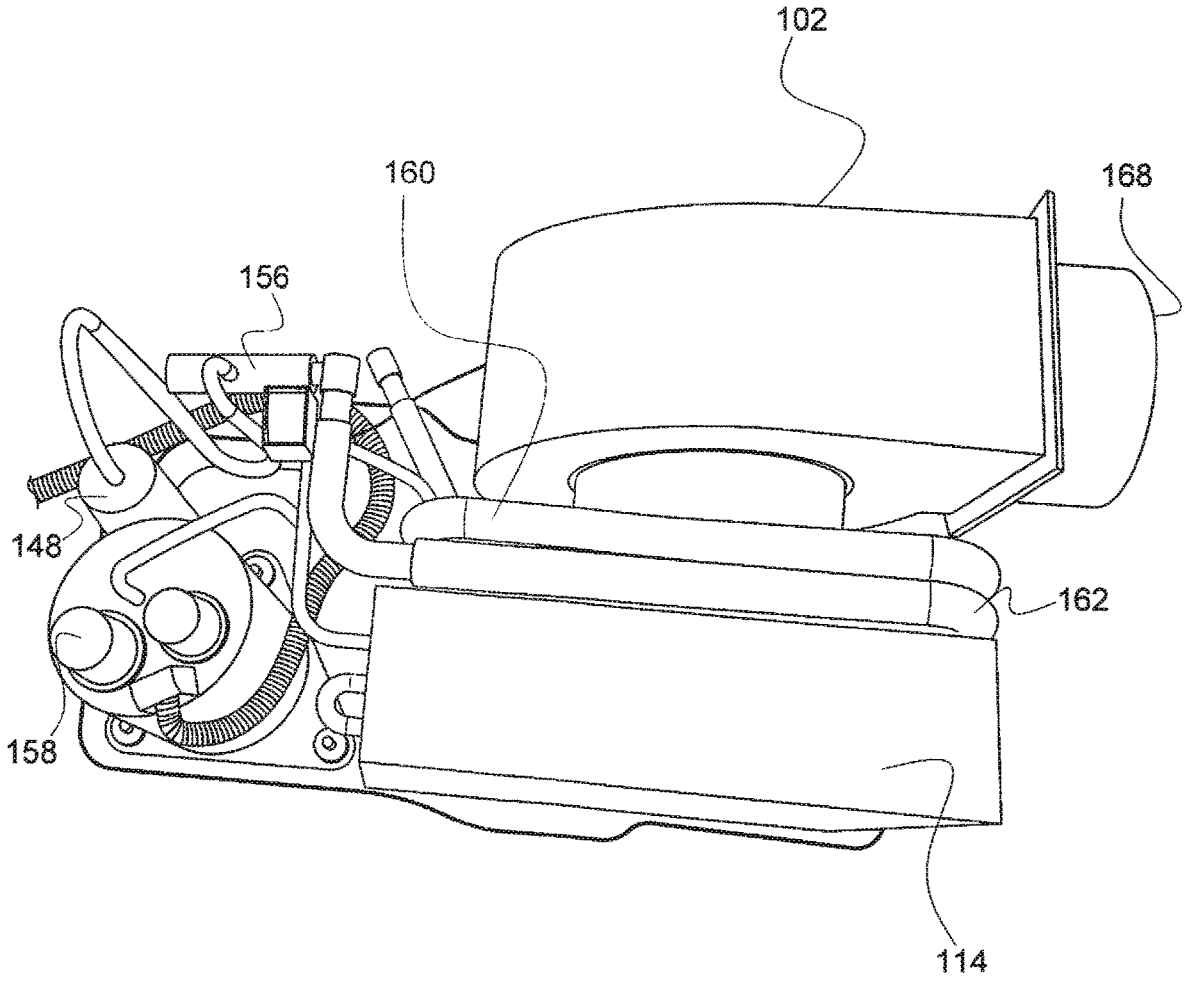
FIG. 13 is a top view of the marine air conditioning unit.
Figure 14:
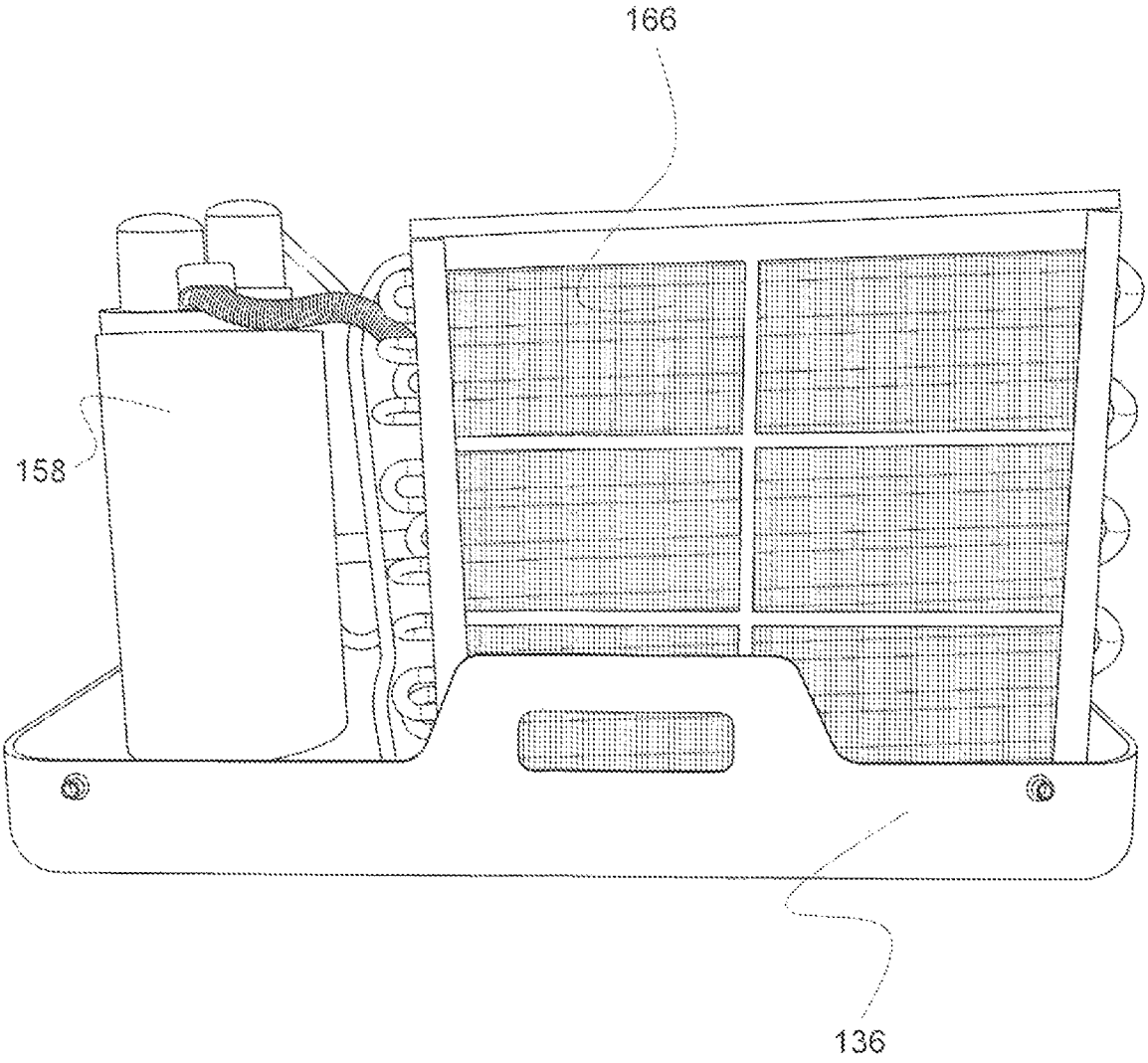
FIG. 14 is a right view of the marine air conditioning unit with evaporator filter.

FIG. 1 is a left-side view of the marine air conditioning unit 100. FIG. 2 is a left-side view of the marine air conditioning unit 100 with blower 102 removed. FIG. 3 is a rear perspective view of the marine air conditioning unit 100 with blower 102 disconnected. FIG. 4 is a right front perspective view of the blower 102 of the marine air conditioning unit 100. FIG. 5 is a right-side view of the blower 102 of the marine air conditioning unit 100. FIG. 6 is an enlarged view of the back left corner of the base drain pan 136 of the marine air conditioning unit 100. FIG. 7 is an enlarged perspective view of the connection point for the blower 102 of the marine air conditioning unit without the replaceable cable tie 178. FIG. 8 is an enlarged perspective view of the connection point for the blower 102 of the marine air conditioning unit 100 with the cable tie 178. FIG. 9 is a rear left perspective view of the marine air conditioning unit 100. FIG. 10 is a rear view of the marine air conditioning unit 100. FIG. 11 is a front view of the marine air conditioning unit 100. FIG. 12 is a right view of the marine air conditioning unit 100 without evaporator filter 166. FIG. 13 is a top view of the marine air conditioning unit 100. FIG. 14 is a right view of the marine air conditioning unit 100 with evaporator filter 166.

The blower assembly 102 is incrementally rotatable up to 270-degrees about a single axis 108. This allows the blower unit to be installed in a variety of locations. This is also an important feature when using this unit as a replacement unit, because the user is installing this in a location that is not directly configured for the marine air conditioner herein.

The blower assembly 102 has an inlet 101 and an outlet 103. The blower assembly 102 is mounted at the inlet 101, wherein the blower fan 104 driven by motor 106 can pull air through the marine air-conditioning unit. The outlet 103 of the blower assembly 102 may then me connected to an insulated duct through use of a duct mounting ring 168, wherein the cool air is expelled from the marine air-conditioning unit 100 into the remainder of the system.

In order to mount the blower assembly 102 to the body of the marine air-conditioning unit 100, a cylindrical mounting bracket 110 is fastened to the blower assembly 102 via connecting screws, which secures the bracket on to the blower.

Also between the evaporator 114 and the blower assembly 102 is a connection bracket 112 having an evaporator side (not shown, but may be appreciated that the evaporator side is a side of the connection bracket 112 which provides coverage to the evaporator 114, as shown in FIG. 2) and a blower side 118. The evaporator side of the connection bracket 112 is configured to cover the evaporator 114. The blower side 118 of the connection bracket 112 includes a central aperture 120 with a cylindrical mounting area 122 with a plurality of screw apertures therein. The cylindrical mounting area 122 is configured to receive the cylindrical mounting bracket 110 within its inner periphery 130 and provide a tight connection between the cylindrical mounting bracket 110 of the blower assembly 102 and the cylindrical mounting area 122 of the blower the 118 of the connection bracket 112 wherein the mounting bracket 110 of the blower assembly 102 is secured to the connection bracket 112 by a plurality of screws 254 that feed through a series of screw apertures (not all shown, but may be appreciated from location of complemental locking screw 254, as shown in FIGS. 7 and 11, which interacts with the series of locking screw apertures) in the cylindrical mounting bracket 110 and the screw apertures in the cylindrical mounting area 122 of the blower side 118 of the connection bracket 112.

Figure 20A:
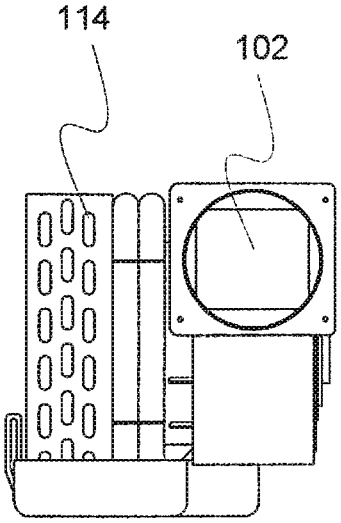
FIG. 20A is a front view of the marine air conditioning unit with screw location.
Figure 20B:
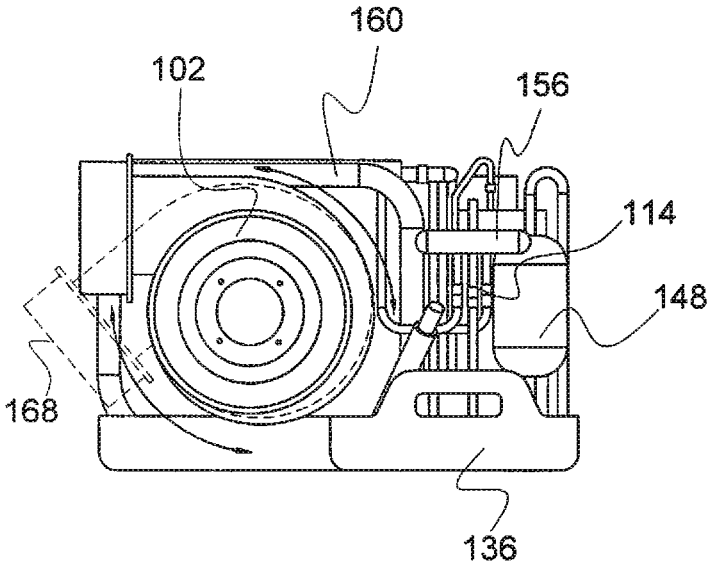
FIG. 20B is a side view of the marine air conditioning unit showing 270-degree rotation of the blower.

This arrangement of components for connecting the blower assembly 102 allows the blower to be incrementally rotated up to 270-degrees. This can be primarily seen in FIGS. 20A and 20B. FIG. 20A is a front view of the marine air conditioning unit 100 with a screw location. FIG. 20B is a side view of the marine air conditioning unit 100 showing 270-degree rotation of the blower 102. The connections of these components are locked when the screws 254 are added, which removes the possibility of the connection slipping or moving when the marine air-conditioning unit 100 is on, even in the presence of vibrations, which have been cause for duct misalignment and connection failures that have plagued the prior art.

To further enhance the seal of the blower 102 to the marine air-conditioning unit 100, a replaceable cable tie 178 is included with the unit 100. The cable tie 178 is responsible for circumferentially providing securement pressure on the cylindrical mounting area 122 of the connection bracket 112, thereby putting pressure on the cylindrical mounting bracket 110 fastened to the blower 102 assembly whereby the pressure assists the locking screws 254 in creating tight fit and reducing any air flow escape.

The unit also contains a base 134 having a base drain pan 136, at least one condensate drain 140, and at least two handles 142. The base 134 is a stainless-steel frame base, which provides support in carrying the weight of the other components and provides a degree of corrosion resistance. The base drain pan 136 is molded into a unitary piece of ABS plastic. This also provides for corrosion protection, and allows for the system to prevent leaking on to the surface in which the unit is mounted to. Also molded into the base drain pan 136 are a plurality of at least two handles 142 formed with the material of the base drain pan 136 and are configured to be located near the heaviest points at the base 134 of the marine air conditioning 100 unit to provide a stable point for a user to pick up the unit 100. While handles in general typically exist at the distal ends of a surface which is intended to be picked up, the weight distribution of air conditioning units can be inconsistently spread out. In a do-it-yourself installation as described herein, the marine air-conditioning unit 100 must be as user-friendly as possible for non-professionals. Therefore, in an ideal embodiment, one handle is located proximal to the evaporator 114 and a second handle is located proximal to the dryer 148. Other handles may also be spread out around the base drain pan, which can be used by a second user helping to carry the marine air-conditioner.

To reduce noise and unwanted shaking, sound and vibration dampening elements 150 are included with the invention. Sounds can become a nuisance, as well as excessive vibration, which can cause shaking or also sounds. Therefore, this invention includes vibration and sound dampening elements 150 already installed so that a user in a do-it-yourself installation does not need to have a professional technician come to install these elements. The vibration dampening elements 150 can include an adhesive foam 152 affixed to an outer surface of the blower assembly 102, a vibration absorbing adhesive tape 154 configured to be affixed to the underside of the base drain pan 136, or both. The adhesive foam 152 around the blower absorbs sound from the motor 106 and fan 104. However, it also insulates the blower and seals any potential leaks wherein chilled air may escape.

The system uses seawater to cool the unit. Because the system uses seawater as a coolant, the condenser coil 160 included is constructed out of titanium to reduce corrosion. Other materials may not be able to withstand constant filtering of seawater as well, and while other materials may technically work, the system's configuration as a do-it-yourself unit uses the titanium to reduce maintenance and extend the life of the unit. The marine air-conditioning unit 100 also includes a coil inflow 164 and a coil outflow 162.

An air filter 166 attached to the evaporator 114 is also included to filter particulates from entering the system. The filter is configured to be thin and take up a minimal footprint, and is constructed to be reusable because of this unique aspect.

Figure 15:
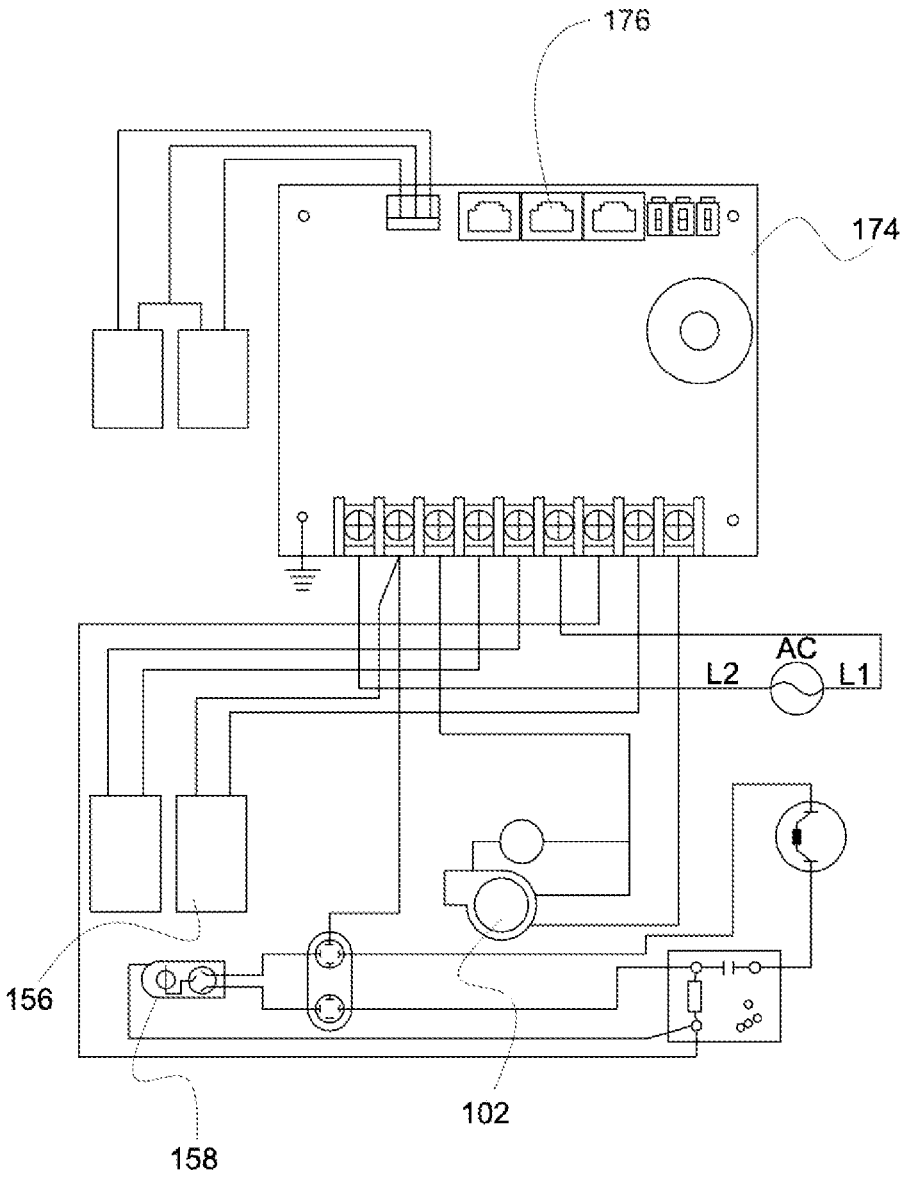
FIG. 15 is a wiring diagram of the universal control board of the marine air conditioning unit.

The system is powered and controlled through an electrical box 170 with fire retardant cover 172, connected to a single plug connection. Inside the electrical box are a power supply (not shown) and a control board 174 with universal connection terminals 176. The control board 174 allows the system to be a replacement unit for third-party marine air-conditioning units, making the overall system an easy installation for a do-it-yourself user. In addition, the system uses a single plug 264 to provide both power and control to the unit, making it further easier for do-it-yourself installations because users only need to connect a single plug 264, rather than mess with wiring and connecting multiple cords. FIG. 15 is a wiring diagram of the universal control board of the marine air conditioning unit.

In a standard configuration, the system will have two cooling circuits, the seawater cooling circuit and refrigerant circuit. In the coolant circuit, the reverse valve 156 connects to the compressor 158, evaporator 114, condenser coil 160, and accumulator. Refrigerant flows from the evaporator 114 to the reverse valve 156, then from the reverse valve 156 to the accumulator and then the compressor 158. The refrigerant will flow from the compressor 158 back through the reverse valve 156 to the condenser coil 160, and then back to the evaporator 114 completing the cycle. Typically, a dryer 148 will be included between the condenser coil 160 and the evaporator 114. The Seawater cooling system 194 is another circuit that brings in fresh seawater and cycles it through the condenser coil 160. However, the seawater circuit does not mix with the refrigerant circuit.

When the air-conditioning unit is in use, ambient air is pulled from the cabin of the watercraft through the grill for the air return 192 by suction created from the blower 102. The air is then pulled passed the coils of the evaporator 114 and into the blower assembly 102. The evaporator 114 cools the ambient air, and the cooled air flows out of the blower 102 and through the thermal foil duct hose 186 and expelled through the grill for the air supply 182 back into the cabin of the watercraft.

Figure 16:
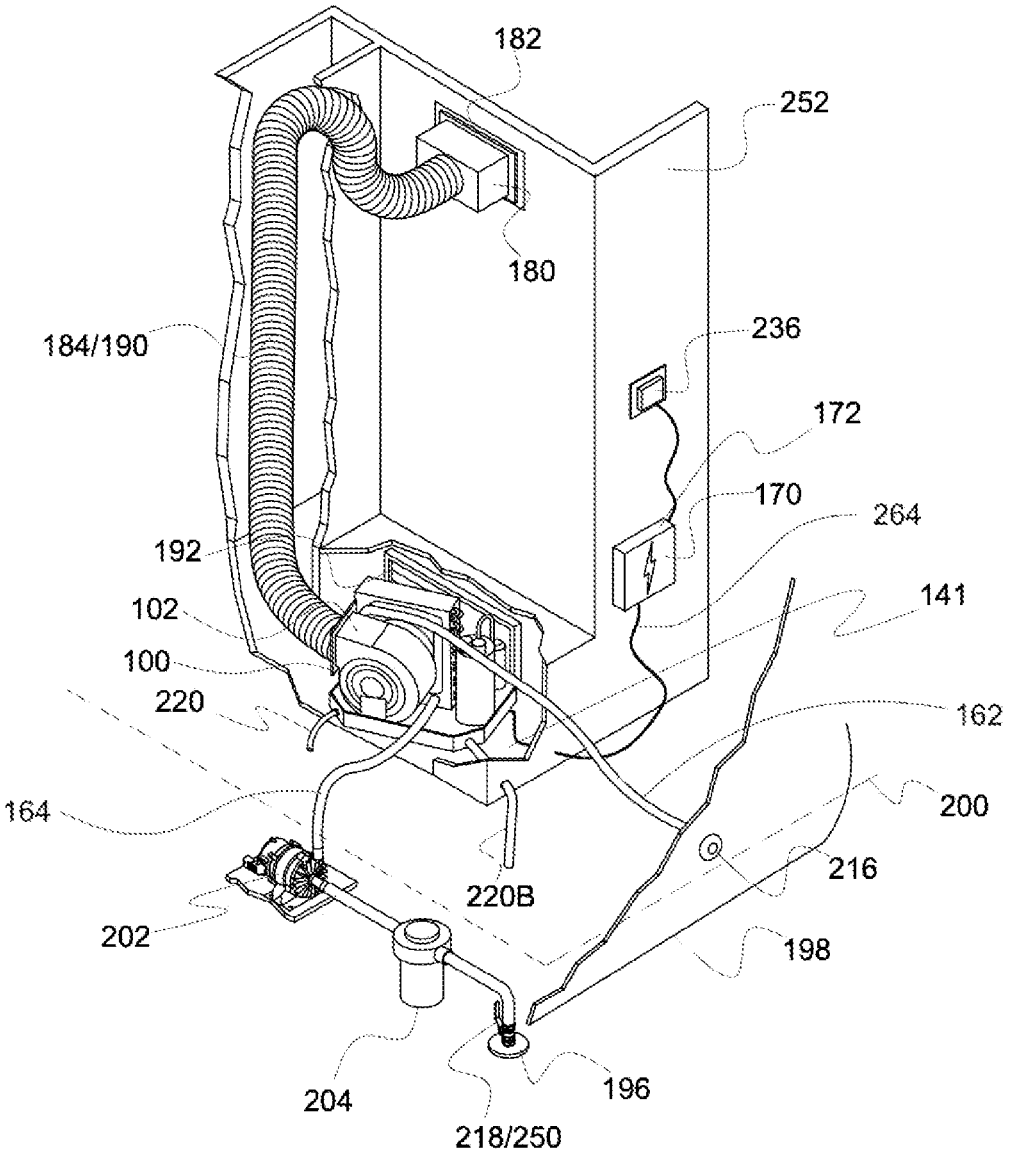
FIG. 16 is a conceptual overview of a marine air conditioning system.
Figure 17:
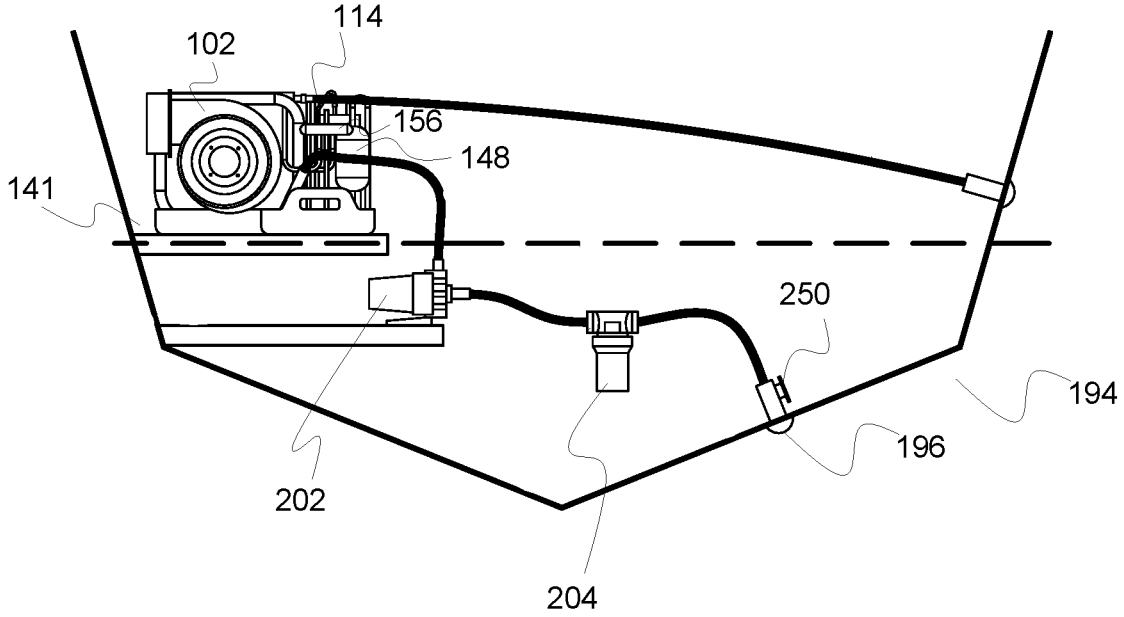
FIG. 17 is a conceptual cross-section view of a hull of a watercraft showing the layout of the seawater cooling system of a marine air conditioning system.

The marine air-conditioning unit is part of a larger marine air conditioning system, which can be more particularly seen in FIGS. 16 and 17. FIG. 16 is a conceptual overview of a marine air conditioning system. FIG. 17 is a conceptual cross-section view of a hull of a watercraft showing the layout of the seawater cooling system of a marine air conditioning system. In some do-it-yourself installations, components of this marine air-conditioning system may already be pre-installed on a watercraft. However, in new installations and new watercraft builds, the marine air-conditioning unit must be attached to the additional components of a marine air-conditioning system to function properly.

In addition to the marine air-conditioner unit 100 described above, the marine air-conditioning system also includes an air supply 180, a grill for the air supply 182, an insulated duct 184 connecting the blower assembly 102 to the air supply 180, an air return 190, a grill for an air return 192, a seawater cooling system 194, a through-hull inlet 196, a pump 202, a strainer 204, marine-grade hoses and piping, a coil inflow hose, a coil outflow hose, an overboard seawater discharge 216, a shut-off valve 218, at least one condensate drain 140, and a system control display unit 236.

In this system, air is pulled in through the grill for the air return 192 and across the coils of the evaporator 114 by the suction created by the blower fan 104. As the air passes the coils of the evaporator 114, the air is cooled and is then pushed out of the blower assembly 102 into the thermal foil duct hose 186 of the insulated duct 184. The cooled air then escapes through the grill for the air supply 182 and into the cabin of the watercraft.

The thermal foil in the thermal foil duct hose 186 may be biaxially-oriented polyethylene terephthalate, known more commonly by its trade name, Mylar®.

The air return 190 is located in close proximity to the evaporator 114 of the marine air conditioning unit. This is so that the marine air-conditioning unit 100 may pull in air with minimal intake ductwork. The air return grill 190 provides protection for the unit to keep out unwanted objects from the cabin that may interfere with the unit.

Because the system is installed on a watercraft, which typically runs off of its own power, be it by generators or batteries, the system configured for maximum efficiency. To further this efficiency, the insulated duct 184 connecting the blower assembly 102 to said air supply 180 further includes an inner thermal foil duct hose 186 with a fiberglass insulation layer 188 that is slidably capable of exposing said inner thermal foil duct hose 186 for installation.

The seawater cooling system 194 includes a through-hull inlet 196 mounted to the hull of a watercraft 198 for taking in fresh seawater and is configured to be under the waterline 200 relative to said watercraft 198. Seawater enters the seawater cooling system 194 at the through-hull inlet 196. The seawater moves through a marine-grade hose connecting the thru-hull inlet 196 to the strainer 204. From there, the strainer 204 to filters out particulates from the seawater. A pump 202 is also included for pulling in fresh seawater through the seawater cooling system 194. Seawater flows through a marine-grade hose connecting the strainer 204 to the pump 202. From the pump 202, the seawater passes through a coil inflow hose connecting the pump 202 to the coil inflow on the marine air conditioning unit 100.

Upon exiting through the coil outflow 162 on the marine air conditioning unit 100, a coil outflow hose connects the coil outflow 162 of the marine air conditioning unit 100 to an overboard seawater discharge 216, wherein the overboard seawater discharge 216 is configured to be above the waterline 200.

A shut-off valve 218 is located proximal to the thru-hull inlet 196 as a manual disconnect between the thru-hull inlet 196 and the seawater cooling system 194.

Figure 23:
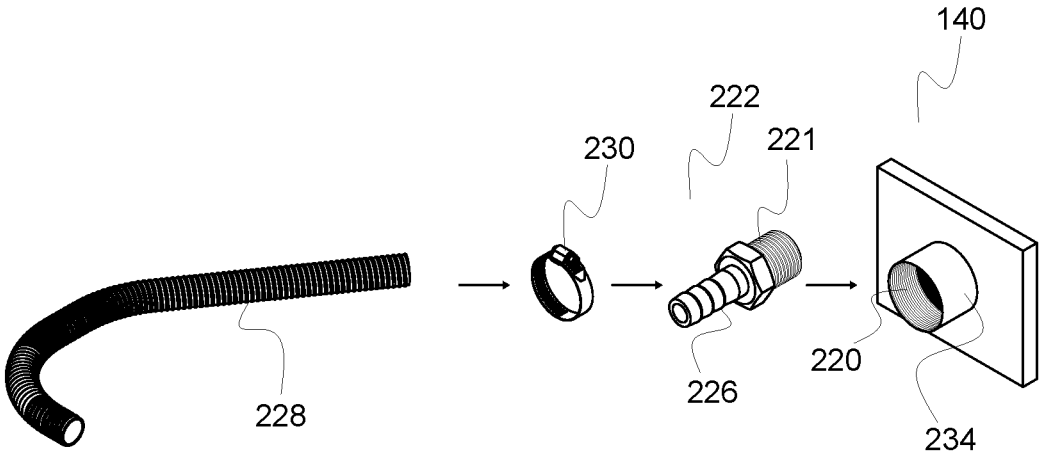
FIG. 23 is an exploded view of a condensate drain, and drain hose components.

Further provided in the system is at least one condensate drain 140. The at least one condensate drain 140 allows the base drain pan 136 to empty. Hose barbs 222 are included to be installed at each drain hole 220 in the base 134 base drain pan 136. FIG. 23 is an exploded view of a condensate drain 140 and drain hose components. A threaded male end 221 of each hose barb 222 engages with a complementally threaded female aperture 234 in the drain hole 220. A marine-grade hose 228 is included, wherein said marine-grade hose 228 is snugly-fitted over the barbed end 226 of said hose barb 222. To secure the drain hose 228 to the hose barb 222, a stainless-steel hose clamp 230 is fitted to provide a secure connection between the hose 228 and the hose barb 222. The hose should drain from a collection point 232 wherein condensate may drain. Any condensate drains should not terminate within three feet of any outlet, engine, or generator exhaust system, nor in a compartment housing an engine or generator, nor in a bilge, unless the condensate drain is connected property to a sealed condensate or shower sump pump.

While included with the marine air-conditioning unit 100, it is important that the system include an air conditioning unit electrical box 170 providing power and control signals to said marine air conditioning system. The electrical box 170 should also include a fire-retardant cover. A universal control board 174 is provided within the air conditioning unit electrical box 170. This universal control board 174 includes universal connection terminals 176, which allow a system control display unit 236 connected to the control board 174 to operate the system as desired per the operation configuration input by a user. Also included is a power and control source connection incorporated within a single plug 264, which allows an easy do-it-yourself installation of the unit without the need for a professional.

In a standard configuration, the marine air conditioning unit 100 is connected to a seawater cooling system 194, wherein the seawater cooling system brings water from the through-hull inlet 196, past the seacock 250, through marine-grade hoses and piping, to the strainer 204 wherein particles can be filtered out. The water then goes from the strainer 204 to the pump 202 and into the condenser coil 160. The water is then pushed out of an overboard seawater discharge 216. The system also includes the air-circulating configuration, wherein air is pulled from the cabin of the watercraft through the air return 190, through the marine air conditioning unit 100 where it is chilled, then through the insulated duct 184, wherein the chilled air will flow out of the air supply 180. An electrical box 170 is connected to the marine air conditioning unit, to provide power and control. In the electrical box 170 is the universal control board 174 with universal connection terminals 176 that allows for the installation of third-party controllers. In a preferred embodiment, the connection will also be included as a universal plug, so that the system can be easily connected and disconnected by a do-it-yourself user, wherein all the connections needed to connect and power the system are all contained in one single plug terminal.

Because this invention is configured for do-it-yourself installations, a method for installing a pre-charged and pre-wired marine air conditioning system is included.

Figure 18:
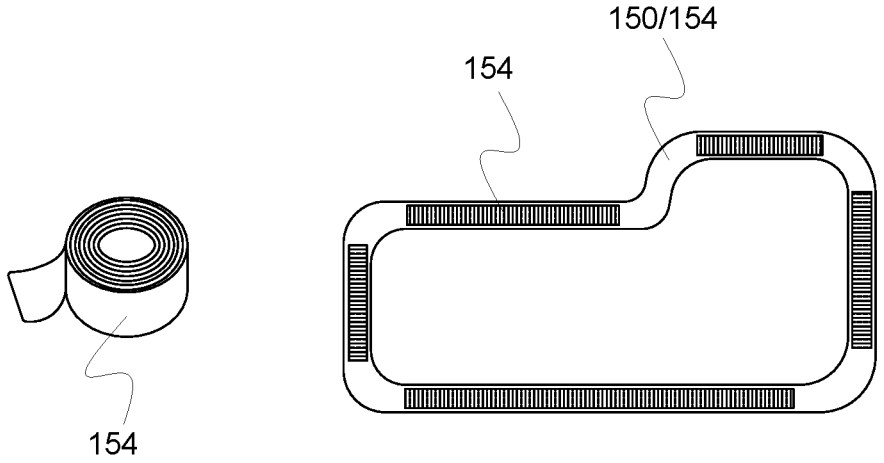
FIG. 18 is a bottom view of the base of the marine air conditioning unit with vibration absorbing adhesive tape.

The steps include providing a marine air conditioning system for easy connections, as described above. Next, the user begins installing vibration absorbing adhesive tape 154 on the base 134 of said marine air conditioner 100 to dampen vibrations, if vibration absorbing adhesive tape 154 is not already installed. FIG. 18 is a bottom view of the base 134 of the marine air conditioning unit 100 with vibration absorbing adhesive tape 154.

Figure 19A:
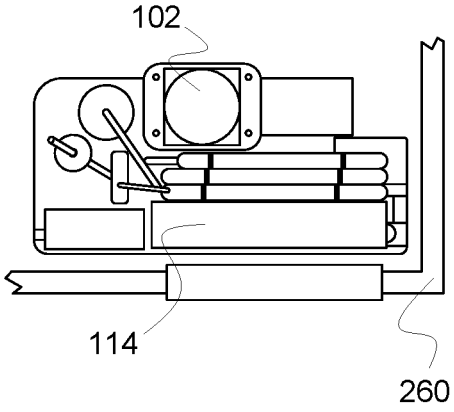
FIG. 19A is a view of a mounting location of the marine air conditioning unit with evaporator parallel to an air return.
Figure 19B:
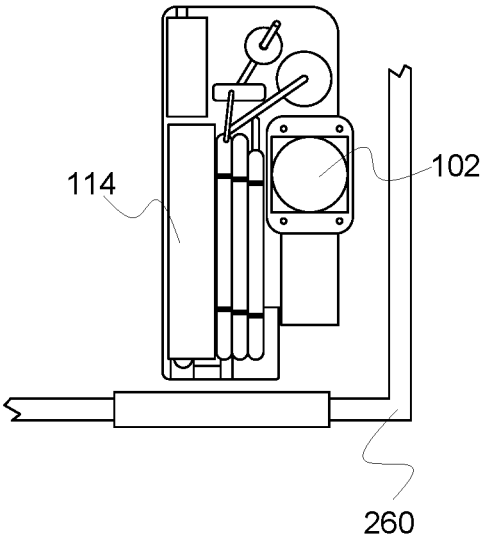
FIG. 19B is a view of a mounting location of the marine air conditioning unit with evaporator perpendicular to an air return.

A user should take into consideration several layout factors when mounting the marine air-conditioning unit 100. This may include mounting the marine air conditioner unit 100 of the marine air conditioning system away from grill for the air return 192 to minimize sound level in a cabin 252 of the watercraft if possible. Also if possible, the user should be mounting the marine air conditioning unit 100 of the marine air conditioning system with the condenser 160 and evaporator 114 directly behind the grill for the air return 192 if adjacent to a bulkhead or other obstruction, or, mounting the marine air conditioning unit 100 of the marine air conditioning system with the condenser 160 and evaporator 114 with at least three inches of air circulation clearance if adjacent to a bulkhead or other obstruction and the marine air conditioning unit 100 cannot be mounted directly behind the grill for the air return 192. It is important that the installer is mounting the marine air conditioner 100 in a location that is sealed from direct access to bilge and engine room vapors. FIG. 19A is a view of a mounting location behind a bulkhead 260 of the marine air conditioning unit 100 with evaporator 114 parallel to an air return 190. FIG. 19B is a view of a mounting location of the marine air conditioning unit 100 with evaporator 114 perpendicular to an air return 190.

The marine air-conditioner unit 100 should be mounted to a low flat surface. Some examples of acceptable locations include the bottom of a locker, under a bunk, under a dinette seat, or similarly configured locations. To ensure proper airflow in these locations, an installer should ensure that the location has a minimum clearance of three-inches in front of the evaporator, and minimum clearance of four-inches in front of the grill for the air return.

Once the marine air conditioner 100 is mounted, the installer proceeds with adjusting a rotational orientation of said blower assembly 102. If needed, by loosening the lock screws 254 from the lock screw apertures, rotating said blower assembly 102 about the blower assembly's single axis 108 perpendicular to said blower fan blades 105 between 0 and 270 degrees, and tightening said lock screws 254 once said blower assembly 102 is adjusted to a desired position.

Figure 21A:
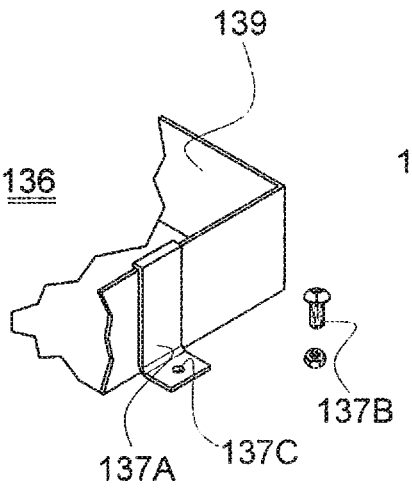
FIG. 21A is an enlarged perspective view of a base drain pan mounting bracket.
Figure 21B:
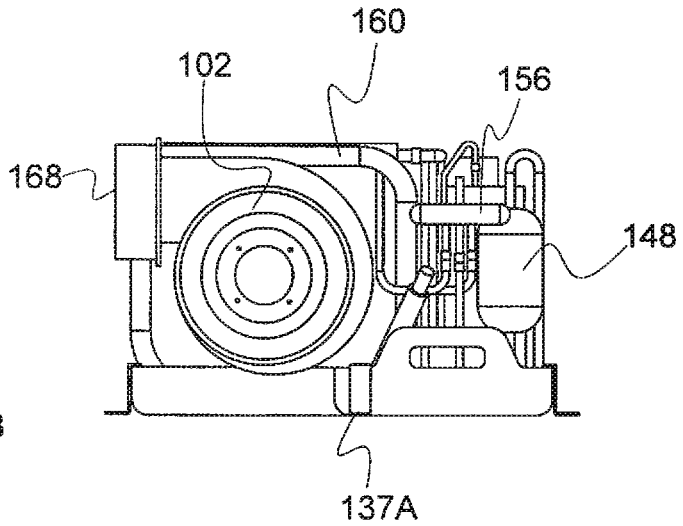
FIG. 21B is a left side view of the marine air conditioning system, showing the location of mounting brackets.

Upon finalizing the position and configuration of the marine air-conditioning unit 100, a user then proceeds by installing a plurality of mounting brackets 137*a* to the base drain pan 136 of the marine air conditioner 100, wherein the mounting brackets 137*a* hook around a lip-wall 139 surrounding said base drain pan 136, wherein a screw 137*b* secures the mounting bracket 137*a* through an aperture 137*c* in a bottom portion of said mounting bracket 137*a* to a flat level mounting surface 141. In an ideal installation, this includes mounting four mounting brackets 137*a*, equally spaced, one at a front point of said base drain pan 136, one at a back point of said base drain pan 136, one at left point of said base drain pan 136, and one at a right point of said base drain pan 136. This will provide stability and securement at each side, especially when the boat is not on calm water. FIG. 21A is an enlarged perspective view of a base drain pan mounting bracket 137*a*. FIG. 21B is a left side view of the marine air conditioning system, showing the location of mounting brackets 137*a*.

With the marine air-conditioner 100 mounted, an installer can then place and tighten a set of hose barbs 222 in each drain hole 220 in the base drain pan 136, wherein a threaded male end 221 of each hose barb 222 engages with a complimental threaded female aperture 234. When these hose barbs 222 are installed, the user can begin fitting a marine grade drain hose 228 over the barbed end 226 of the hose barbs 222, and fastening a stainless steel hose clamp 230 to provide a secure connection between the drain hose 228 and the hose barb 222. The drain hoses 228 will need to be routed from a collection point 232. Condensate drains should not terminate within three feet of any outlet, engine, or generator exhaust system, nor in a compartment housing an engine or generator, nor in a bilge, unless the condensate drain is connected property to a sealed condensate or shower sump pump.

Figure 22A:
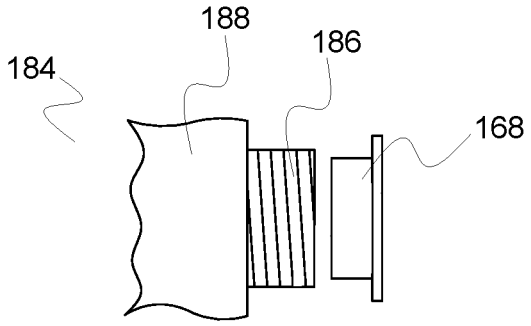
FIG. 22A is a side view of an insulated duct aligning up with a duct mount.
Figure 22B:
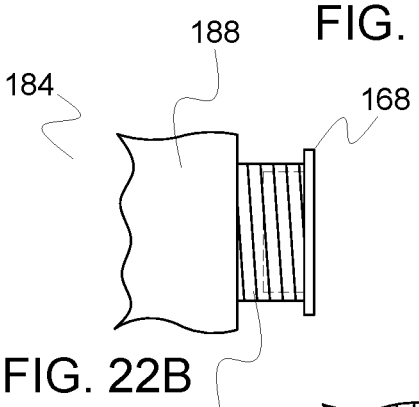
FIG. 22B is a side view of an insulated duct engaging with a duct mount.
Figure 22C:
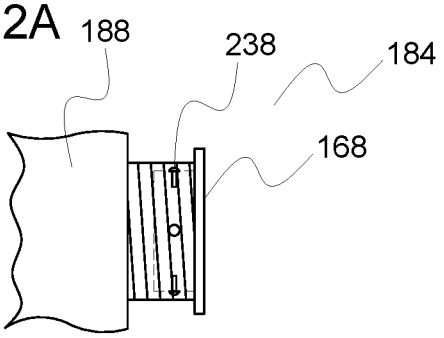
FIG. 22C is a side view of an engaged insulated duct and duct mounting ring with securement screws.
Figure 22D:
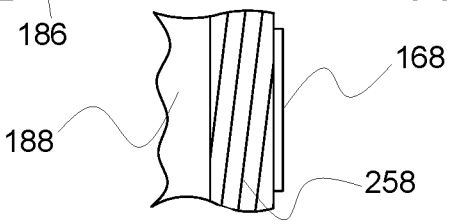
FIG. 22D is a side view of an engaged insulated duct and duct mounting ring sealed with condensation inhibiting tape.

An installer can connect the marine air conditioner 100 to the marine air conditioning system by connecting the marine air conditioner 100 to an insulated duct 184 by sliding back the fiberglass insulation layer 188 on the insulated duct 184 to reveal the inner thermal foil duct hose 186. FIG. 22A is a side view of an insulated duct 184 aligning up with a duct mounting ring 168. FIG. 22B is a side view of an insulated duct 184 engaging with a duct mounting ring 168. The installer may then proceed by screwing at least three stainless steel screws 238 through the thermal foil duct hose 186 into the duct mounting ring 168, making sure internal structural wires of said thermal foil duct hose 186 are secured by said screws 238 to securely fasten said thermal foil duct hose 186 to said duct mounting ring 186. FIG. 22C is a side view of an engaged insulated duct 184 and duct mounting ring 168 with securement screws 238. Once the thermal foil duct hose 186 is mounted to the duct mounting ring 186, an installer can slide the fiberglass insulation layer 188 back over the inner thermal foil duct hose 186, thereby covering the thermal foil duct hose 186. The installer should then seal the fiberglass insulation layer 188 on said insulated duct 184 to the duct mounting ring 168 with a condensation inhibiting tape 258. This tape 258 is ideally aluminum foil tape. FIG. 22D is a side view of an engaged insulated duct 184 and duct mounting ring 168 sealed with condensation inhibiting tape 258.

An installer can connect an outflow 242 of the pump 202 to the coil inflow 164 on the marine air conditioner 100 with a reinforced marine-grade hose. This will allow the seawater cooling system 194 to help cool the marine air conditioner 100. To make sure the water is able to drain, an installer will connect the coil outflow 162 on the marine air conditioner 100 to an overboard seawater discharge 216 with a marine-grade hose.

The system operates using a universal control board. This allows the marine air conditioner 100 to work with control equipment, which is especially valuable when using this marine air-conditioning unit 100 as a replacement. An installer will connect the marine air-conditioning unit 100 to a universal control board 174 configured to work with third-party thermostat systems. Using a single plug connection for ease of do-it-yourself installation by non-professionals allows the non-professional to easily install the unit with minimal complication. The installer will then connect a thermostat system with control display 236 to the connection terminal 176 in said electrical box 170.

While the marine air-conditioning unit 100 is a practical solution for replacement situations, it is also a good solution for new installs as well. If not already included in the watercraft, or if the watercraft is under construction, an installer may also place a thru-hull fitting 196 away from a waterline 200, wherein slots (not shown, but may be appreciated from the thru-hull fitting 196 as shown in FIGS. 16 and 17, wherein it should be understood that the thru-hull inlet includes an opening, as is typical in the art, but the opening will be directed toward the forward direction of the watercraft) of the thru-hull fitting 196 are directed towards the bow of said watercraft to obtain positive pressure in the suction line 246. This step is included if a thru-hull fitting 196 does not exist in the watercraft for the air conditioning equipment, or if a thru-hull fitting 196 in general is not already installed in the watercraft. An installer may place a bronze seacock 250 on the thru-hull fitting, if a seacock 250 does not exist in the watercraft for air conditioning equipment. If a pump does not exist in the watercraft for air conditioning equipment, the installer may install a pump 202 at a level of at least 30 inches below the waterline 200, except when a self-priming pump is used. The installer may install a strainer 204 below the level of the pump 202, if a strainer does not exist in the watercraft for air conditioning equipment. The installer may connect the seacock 250 and strainer 204 with a reinforced marine-grade hose if a seacock and strainer are not installed in the watercraft. The installer may connect the strainer 204 and the pump 202 with a reinforced marine-grade hose if a strainer and a pump are not already installed in the watercraft.

While there has been shown and described above the preferred embodiment of the instant method it is to be appreciated that the method may be embodied otherwise than is herein specifically shown and described and that, within said method, certain changes may be made in the form and arrangement of the parts without departing from the underlying ideas or principles of this method as set forth in the Claims appended herewith.

I claim:

1. A mounting system for a self-contained marine air conditioning unit having a seawater cooling circuit including a titanium condenser coil with a coil inflow and coil outflow, a refrigerant circuit with a reverse valve connecting a compressor, an evaporator, a blower assembly mounted in communication with said evaporator, a refrigerant tube thermally engaged with the titanium condenser coil, an electrical box with fire retardant cover, a control board with universal connection terminals, and a power and control source connection incorporated within a single plug, wherein the improvement comprises:

a cylindrical mounting bracket fastened to said blower assembly;

a connection bracket between said evaporator and said blower assembly having a blower side and a side opposite of said blower side, covering said evaporator;

said blower side of said connection bracket includes a central aperture with a cylindrical mounting area; and said cylindrical mounting area is configured to receive said cylindrical mounting bracket within its inner periphery and provide a tight connection between said cylindrical mounting bracket of said blower assembly and said cylindrical mounting area of said blower side of said connection bracket wherein said mounting bracket of said blower assembly is secured to said connection bracket by a plurality of locking screws that feed through said cylindrical mounting bracket and said cylindrical mounting area of said blower side of said connection bracket.

* * * * *